US011321986B2

(12) United States Patent
Menot et al.

(10) Patent No.: US 11,321,986 B2
(45) Date of Patent: May 3, 2022

(54) RAPID VACUUM SEALING SYSTEM FOR CASH BAG

(71) Applicant: Crane Payment Innovations, Inc., Malvern, PA (US)

(72) Inventors: Sebastien Menot, Thoiry (FR); Jorge Rive, Phoenixville, PA (US); Neil Young, Downington, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 449 days.

(21) Appl. No.: 16/319,769

(22) PCT Filed: Oct. 17, 2017

(86) PCT No.: PCT/US2017/057038
§ 371 (c)(1),
(2) Date: Jan. 22, 2019

(87) PCT Pub. No.: WO2018/075555
PCT Pub. Date: Apr. 26, 2018

(65) Prior Publication Data

US 2020/0320818 A1 Oct. 8, 2020

Related U.S. Application Data

(60) Provisional application No. 62/409,327, filed on Oct. 17, 2016.

(51) Int. Cl.

| | |
|---|---|
| ***G07D 11/125*** | (2019.01) |
| ***G07D 11/00*** | (2019.01) |
| ***B65B 25/14*** | (2006.01) |

(52) U.S. Cl.
CPC ..... *G07D 11/0096* (2013.01); *B65B 25/14* (2013.01); *G07D 11/125* (2019.01)

(58) Field of Classification Search
CPC ..... G07D 11/0096; G07D 11/125
See application file for complete search history.

(56) References Cited

U.S. PATENT DOCUMENTS 6,112,539 A * 9/2000 Colberg ..... G07F 11/68 62/331
2003/0220064 A1* 11/2003 Svensson ..... B65B 9/02 453/59

(Continued)

FOREIGN PATENT DOCUMENTS

KR 10-2016-0087062 A 7/2016
WO 2011054502 A1 5/2011

(Continued)

OTHER PUBLICATIONS

European Patent Office, "Communication pursuant to Rules 161(1) and 162 EPC," Application No. EP17792264.8, dated May 24, 2019, 3 pages.

(Continued)

*Primary Examiner* — Christle I Marshall

(57) ABSTRACT

An embodiment of this disclosure provides a sealing system for cash bags. The system includes a banknote validator, a head coupled to the banknote validator, a bag of a roll of bags, the bag configured to mount to the head, a first sealing mechanism coupled to the head and configured to seal a top portion of the bag, a second sealing mechanism configured to seal a bottom portion of the bag, and a vacuum pump configured to connect to the bag and configured to pump air from the bag.

17 Claims, 27 Drawing Sheets

(56) References Cited

U.S. PATENT DOCUMENTS

| | | | | |
|---|---|---|---|---|
| 2013/0213763 | A1* | 8/2013 | Rao | G07D 11/12 194/350 |
| 2016/0031574 | A1* | 2/2016 | Razzaboni | B65B 7/02 53/268 |
| 2019/0330005 | A1* | 10/2019 | Yokoo | B65B 25/14 |

FOREIGN PATENT DOCUMENTS

| | | | |
|---|---|---|---|
| WO | 2012040360 | A1 | 3/2012 |
| WO | 2014181290 | A1 | 11/2014 |

OTHER PUBLICATIONS

ISA/EPO, International Search Report and Written Opinion of the International Searching Authority for International Application No. PCT/US2017/057038, dated Jan. 25, 2018, 14 pages.
Communication pursuant to Article 94(3) EPC dated Jan. 21, 2022, in connection with European Application No. 17792264.8, 5 pages.

* cited by examiner

RAPID VACUUM SEALING SYSTEM FOR CASH BAG

CROSS-REFERENCE TO RELATED APPLICATIONS

This application is the National Stage of International Patent Application No. PCT/US2017/057038, filed Oct. 17, 2017, which claims the benefit of Provisional Application No. 62/409,327, filed Oct. 17, 2016, the disclosures of which are incorporated herein by reference into the present disclosure as if fully set forth herein.

TECHNICAL FIELD

This disclosure relates generally to sealing cash bags attached with banknote validators. More specifically, this disclosure relates to a tamper evident cash bag vacuum sealing system with a head, spring loaded top sealing mechanism and multipurpose spring loaded stack organizer.

BACKGROUND

Cash-in-Transit (CIT) personnel can collect cash by having scheduled pick up times such as once a week or three times a day (depending upon the cash flow of the customer), or the personnel can come in after the cash bag is full. Upon arrival, the CIT personnel could have a cash bag system seal the cash bag, open the safe, and remove the sealed cash bag from the safe. After removing the cash bag, CIT personnel can mount the next cash bag in the safe, then lock the safe and carry the sealed bag away. Current bagging solutions in the market take a long time to seal, use expensive cash bags, and require special skills on the part of CIT personnel. In addition, the stack of banknotes generated is not stable if it is not handled delicately by CIT personnel, Reorganizing the stack after bag opening takes time. In some bagging systems, the bag itself adds another layer of jams due to static electricity build up causing reliability issues.

SUMMARY

This disclosure provides a sealing system for cash bags. The system includes a banknote validator. The system further includes a head coupled to the banknote validator. The system further includes a bag configured to mount to the head. The system further includes a first sealing mechanism coupled to the head and configured to seal a top portion of the bag. The system further includes a second sealing mechanism configured to seal a bottom portion of the bag. The system further includes a vacuum pump configured to connect to the bag and configured to pump air from the bag.

This disclosure provides a vacuum sealing system. The system includes a head configured to mount a bag on the outside of the head. The system further includes a pressure plate coupled to at least one spring to apply pressure against a stack of banknotes. The system further includes a bottom sealing mechanism coupled to the pressure plate.

This disclosure provides a method for vacuum sealing a cash bag. The method includes receiving a bag mounted on the outside of a head, wherein a bottom surface of the bag is disposed on a pressure plate. The method further includes receiving a stack of banknotes in the bag. The method further includes moving the pressure plate down in response to receiving the stack of banknotes. The method further includes thermally sealing a top of the bag with a top sealing mechanism when the stack of banknotes includes a certain amount of banknotes. The method further includes vacuuming air from the bag with a vacuum pump. The method further includes thermally sealing a bottom of the bag with a bottom sealing mechanism.

This disclosure provides a tamper evident cash bag vacuum sealing system with a head, spring loaded top sealing mechanism and multipurpose spring loaded stack organizer. Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 22, discussed below, and the various embodiments used to describe the principles of the present disclosure in this patent document are by way of illustration only and should not be construed in any way to limit the scope of the disclosure. Those skilled in the art will understand that the principles of this disclosure may be implemented in any suitably arranged device or system.

The embodiment of the vacuum sealing system illustrated in FIGS. 1-22 is for illustration only. FIGS. 1-22 do not limit the scope of this disclosure to any particular implementation of a vacuum sealing system.

As used throughout this specification, the terms currency denomination, denomination of currency, valuable document, currency bill, bill, banknote, note, hank check, paper money, paper currency, coin, coinage, and cash may be used interchangeably herein to refer to a type of a negotiable instrument or any other writing that evidences a right to the payment of a monetary obligation, typically issued by a central banking authority.

Various embodiments of this disclosure recognize and take into account that current systems for sealing cash bags attached with banknote validators are expensive. Current cash bags use the same amount of bag for any number of banknotes. This is a particular problem for keeping operational costs low for customers. If the capacity of the cash bag is 500 banknotes and the customer seals the bag after 150 bank notes then this repeated use could make operational cost more expensive. Many existing cash bags work without a vacuum. The lack of a vacuum can lead to poor stacking during transportation. In freefall or stackerless cash bags, static electricity build up could also lead to a jam.

One or more embodiments of this disclosure provide a cost effective rapid vacuum sealing system for cash bags, for different services, such as cash in transit (CIT) services.

Figure 1:
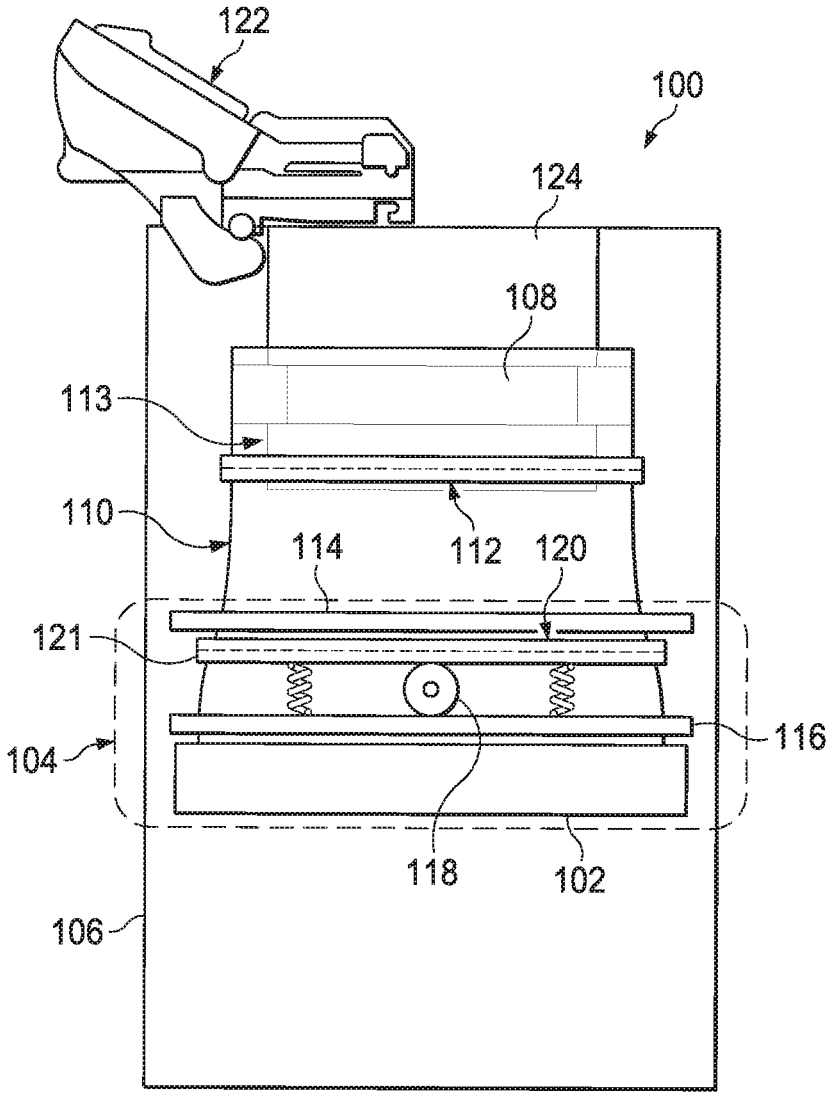
FIG. 1 illustrates a schematic view of a rapid vacuum sealing system for cash bags according to various embodiments of the present disclosure.

FIG. 1 illustrates a schematic view of a rapid vacuum sealing system 100 for cash bags according to various embodiments of the present disclosure. Sealing system 100 for cash bags according to various embodiments of the present disclosure. Sealing systems come in a wide variety of configurations, and FIG. 1 does not limit the scope of this disclosure to any particular implementation of a sealing system.

In FIG. 1, the rapid vacuum sealing system 100 can use a roll of bags 102 having one smooth side and one textured area. The roll of bags 102 can be mounted on either a multipurpose spring loaded stack organizer 104 or near the bottom of a safe 106. The roll of bags 102 is mounted on a hexagonal head 108 externally to the safe (using sliding tracks). A bag 110 is mounted around the hexagonal head 108. The hexagonal head 108 creates a solid box inside the bag 110, which keeps the bag 110 open. The hexagonal head 108 also prevents or minimizes banknotes touching the sides of the bag 110 during a free fall. In one embodiment, the hexagonal head 108 is a conductive material, which also prevents the notes from sticking on the side of the bag 110 due to static electricity. The hexagonal head 108 may have sensors to detect if the banknote path is clear and if the bag 110 is mounted properly. The hexagonal head 108 has 2 states: open or closed. When opened, the hexagonal head 108 is a hexagonal box with a volume that fits the banknotes size. When closed, the hexagonal head 108 becomes flat and is mounted inside the bag 110, which flattens the bag 110 for a perfect sealing without folds. In some embodiments, the head 108 may be other shapes such as a parallelogram, an octagon, or other suitable shapes.

A top sealing mechanism 112 may be below the hexagonal head 108. The top sealing mechanism 112 may be a spring loaded mechanism that is opened manually by the CIT operator during the bag installation. Hooks or some other suitable locking mechanism can lock the top sealing mechanism 112 in an open position. When the hooks are unlocked, the top sealing mechanism 112 is released. Loaded springs can cause the top sealing mechanism 112 to then move back to an original position. The bag can be closed by pressing and sealing with heat welding. The top sealing mechanism 112 is connected to the hexagonal head 108, and when closing also closes the hexagonal head 108 as well as flattens the bag 110 for better sealing quality.

Below the sealing mechanism 112, there is the multipurpose spring loaded stack organizer 104. The organizer 104 can move up and down using a motor. In one example embodiment, the organizer 104 can vibrate to shake to allow the stack of banknotes to organize through shuffling. The organizer 104 includes a pressure plate 114 that supports the weight of the stack of banknotes. The pressure plate 114 is connected to a lifter 116 with compression springs preloaded at a specific weight. The weight can be selected based on an expected weight of the banknotes when the bag 110 is full. In one example, the weight is twenty kilograms. A piercing head 118 is placed between the pressure plate 114 and lifter 116. This piercing head 118 contains a knife or other piercing object that can pierce the bag 110 and connect a vacuum pump airtight with the bag 110 during pumping of the air. Above the piercing head 118 is a bottom sealing mechanism 120 that includes arms 121 (two arms) that slide to close and seal the bottom of the bag. Both the piercing head 118 and the bottom sealing mechanism 120 are actuated by the relative movement between the pressure plate 114 and the lifter 116. The roll of bags 102 is fastened to the lifter 116 and is pulled when the lifter 116 moves down.

When the CIT personnel come to install a new bag, the top sealing mechanism 112 may be first manually opened. In one embodiment, the top sealing mechanism 112 must be opened first. In another embodiment, the top sealing mechanism 112 can be opened by a motor or some other automatic mechanism. The motion of opening the top sealing mechanism 112 loads a spring that can create the necessary force to close the top sealing mechanism 112 and seal the top of the bag 110. After opening the top sealing mechanism 112, the CIT personnel slides the hexagonal head 108 out of the safe 106 and installs the bag 110 around it. Once the bag 110 is loaded, the operator slides the hexagonal head 108 with the bag 110 back into the safe 106.

The system 100 can h accept the banknotes. Once a banknote validator 122 is activated and accepts genuine banknotes, the genuine banknotes freefall through a note drop chamber 124 into the bag 110. Gradually, as the banknotes stack in the bag 110, the multipurpose spring loaded stack organizer 104 moves down to keep the banknote drop height constant. The banknote drop height can be the amount the banknotes fall from the validator 122 before reaching the top of the stack (or the bottom of the bag 110 in the case of a first banknote). By moving down, the multipurpose spring loaded stack organizer 104 pulls more bag from the roll 102 as more banknotes are accumulated during the course of the business.

In one embodiment, the CIT personnel, upon arrival to pick up the bag 110 with the cash loaded, can initiate the sealing procedure. In another embodiment, host software can also initiate the sealing procedure upon receiving a fixed amount of banknotes or at a fixed time of the day. In addition, a local operator could also initiate sealing procedure. In yet a further embodiment, a special coupon could be inserted into an acceptor head to initiate the sealing mechanism 112 as well. Additionally the special coupon could have information such as how much money is in the bag, what time the bag is sealed, operator and location information, or CIT personnel information. In one example the first step in the process is to move the lifters 116 down to provide enough room for top sealing mechanism 112 to operate and to not trap any of the banknotes in the seal.

When the closure of the top sealing mechanism 112 is initiated, arms 113 of the top sealing mechanism 112 close together and, at the same time, the hexagonal head 108 becomes flat. By becoming flat, the hexagonal head 108 can flatten the bag 110 as well to weld its top without folds. The sealing arms 113 of the top sealing mechanism 112 apply force on the bag 110 to close the top of the hag 110. The hag 110 may not be sealed or air tight yet at this stage.

After the top of the bag 110 is closed, the lifters 116 move up to compress the stack against the sealing arms 113 that have just been closed. Compressing the stack pushes extra air from the bag 110 through the closed top. In one embodiment, the bag 110 may still not be sealed nor air tight at this time. Compressing the stack may also increase the rigidity of the stack and keep the stack organized. Once the extra air is forced out via the compression, the spring loaded top heat-sealing mechanism begins the sealing process by heat welding portions of a heat sealer included on the arms 113 to thermally seal the bag when the two arms are closed around the hexagonal head. The maximum compression can be detected (by sensors, relay or switches) when the lifter 116 push enough of the stack to achieve the preloaded force of the compression spring that connects the pressure plate 114 with the lifter 116. The maximum compression can be defined based on a set of springs. If a different maximum compression is desired, a different set of springs can be used. The maximum compression can be a function of the preloading of the springs on the pressure plate 114 as well as the travel distance of the pressure plate 114 allowed before tripping a sensor (or relay or switch). When the force of the lifter 116 equalizes the preloaded compression force of the stack, the lifter 116 can come closer to the pressure plate 114. The movement of the lifter 116 corning closer to the pressure plate 114 can be detected by a sensor to start the top heat sealing.

After beginning of the heating of the bag 110 for sealing, or after completion of sealing process, the lifter 116 moves up again closer to the pressure plate 114. This movement can be used to slide or to apply the vacuum head against the bag 110. A covered knife (piercing head 11) punctures the bag 110 and covers the punched hole in the bag 110 with a gasket on both sides of the bag 110. The vacuum is then turned on.

Once the vacuum of the bag 110 is completed, a second upward movement of the lifter 116 then initiates a bottom sealing operation by applying and pushing the bottom heat sealing mechanism 120 on the bag 110, just below the stack, and just above the punched hole.

Once the bag 110 is sealed the safe 106 can be opened. Cutting of the bag 110 could be automatic (a third upward movement of the lifter 116 could cut the bag 110), or CIT personnel could cut the sealed bag 110. The CIT personnel could then disengage the top sealing mechanism 112 and mount the open end of the bag on the hexagonal head 108 for the next cash accumulating cycle. The part of the hag 110 that stays inside the safe 106 can be kept in place in the lifter 116 by a holding mechanism (like a small roll that can only turn in one direction) for easy access for the next installation.

The proposed cycle for the system 100 could take as little as thirty seconds to compete all of the following steps including sealing the top of the bag 110, vacuuming the bag 110, and sealing the bottom of the bag 110 in a serial sequence. This rapid vacuum sealing system 100 is capable of using only a limited amount of bag and reduces the time and skill required by CIT personnel for cash pick up.

Figure 2B:
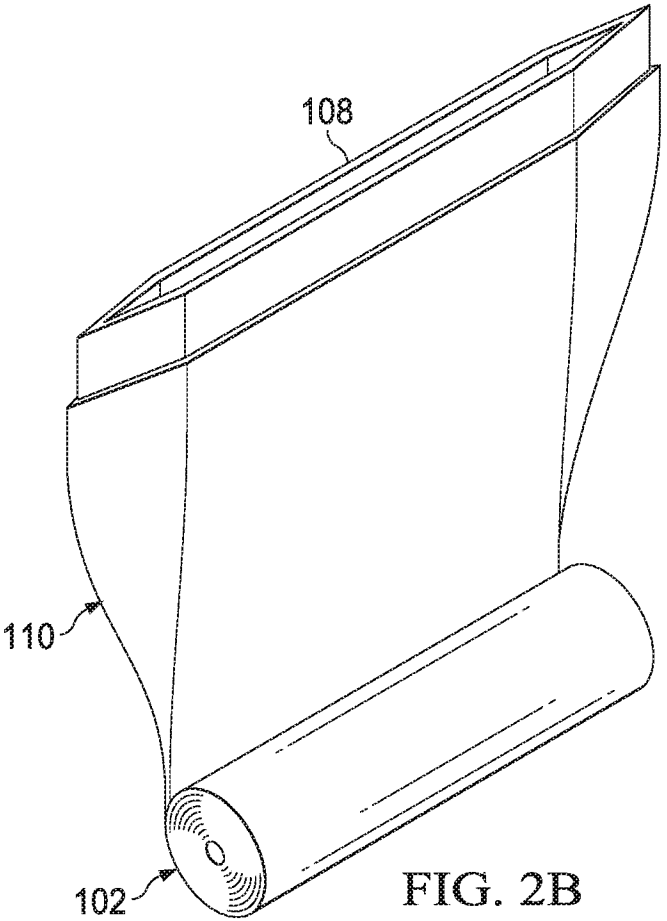
FIGS. 2A and 2B illustrate a bag pulled out from the roll of the bag and mounted on a hexagonal head according to various embodiments of the present disclosure.
Figure 2A:
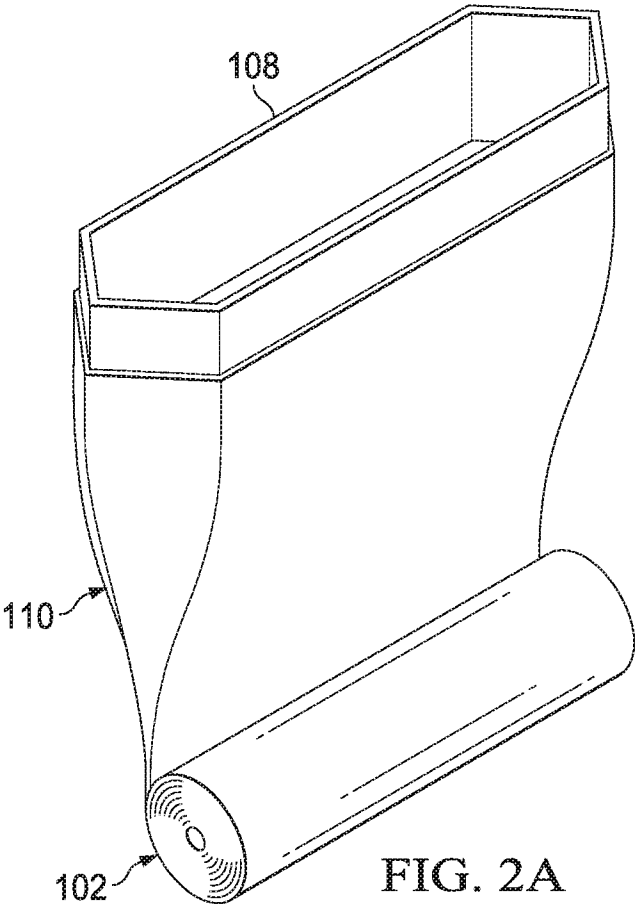

This system has three sub-systems, the hexagonal head 108, the spring loaded top sealing mechanism 112, and the multipurpose spring loaded stack organizer 104. All three sub-systems could be interdependent and operate in either parallel or in serial; however, their interdependency is not necessary to achieve necessary performance, with addition or removal of some of the components, the three sub-systems could act independently from one another FIGS. 2A and 2B illustrate the bag 110 pulled out from a roll 102 of the bag and mounted on the hexagonal head 108 according to various embodiments of the present disclosure. Bags come in a wide variety of configurations, and FIGS. 2A and 2B do not limit the scope of this disclosure to any particular implementation of a bag. For example, bag 110 can be used in sealing system 100 as shown in FIG. 1.

In FIGS. 2A and 2B, the bag 110 is mounted on the hexagonal lead 108 in a manner such that the bag 110 does not block a path for a freefall of a banknote. This arrangement does not allow the bag 110 to block the banknote path and create a jam at the entrance of the bag. In addition, with the bag 110 mounted on the outside of the hexagonal head 108, the hexagonal shape remains constant and defines a fixed surface area for the banknote to freefall. Moreover, the height of the hexagonal head 108 creates a buffer height before the freefalling banknote comes into contact with the actual bag surface.

This short and mostly consistent path provides an advantage in operation of the system by creating a predictable behavior of the banknote entering into the system as all the banknotes travel roughly a similar distance. This prevents banknotes from turning over, or flying around and sticking to one of the sides thereby reducing quality of the stack.

As the bag walls do not form the initial path of the freefalling banknote the static charge buildup in bag is minimized. Moreover, as the inside of the bag is always connected to the head and therefore preventing static electric charge buildup, the performance of the system is improved by reducing jams caused by banknotes sticking to the bag due to static electric charge.

The rigidity of the sides or surfaces of the hexagonal head 108 provide a good surface to mount sensors to detect if the banknote has cleared the freefall path. A sensor can also be placed to check if the bag is mounted properly. Indicator lights or a LCD display could also be provided on the head to improve troubleshooting and user friendliness.

The hexagonal head 108 is collapsible and has two states: open or closed. FIG. 2A illustrates the hexagonal head 108 in the open state and FIG. 2B illustrates the hexagonal head 108 in the closed state. When open, the hexagonal head 108 forms the note drop chamber 124, a rectangular box with a volume that fits the banknote's size. This state is for cash accumulation. When closed, the hexagonal head 108 becomes flat and as it is mounted inside the bag 110, it flattens the bag 110 as well for a perfect sealing without folds. This flatness of the bag surface prepares the bag 110 for the heat sealing by reducing folds generated on the surface as well as reducing the length and force used to seal the bag 110. In addition, the collapsible head also improves mounting of the bag 110, as it is easier to mount the bag 110 when the bag 110 is in the collapsed state.

Figure 3:
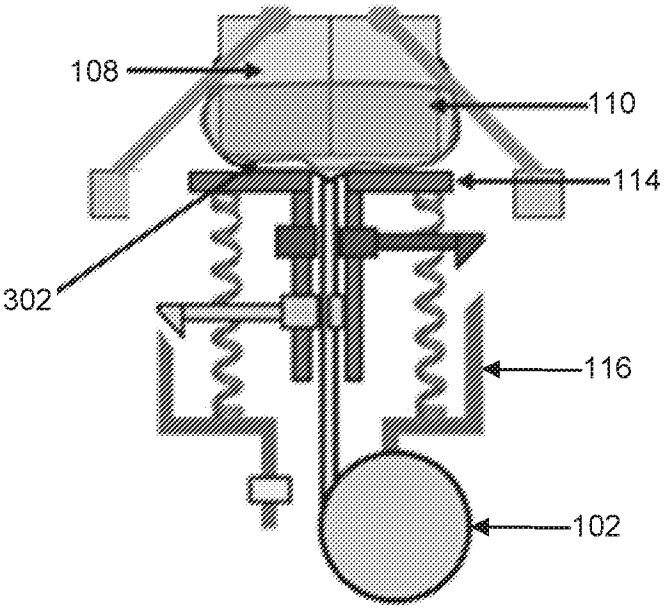
FIG. 3 illustrates a bag with a pressure plate underneath according to various embodiments of the present disclosure.

FIG. 3 illustrates the bag 110 with the pressure plate 114 underneath according to various embodiments of the present disclosure. Pressure plates come in a wide variety of configurations, and FIG. 3 does not limit this disclosure to any particular implementation of a pressure plate. For example, the bag 110 and pressure plate 114 can be part of the sealing system 100 as shown in FIG. 1.

In FIG. 3, the hexagonal head 108 can force the bag 110 to stay open and remain extended at a bottom of the bag 110 thereby causing a bottom surface 302 of the bag 110 to be flatter due to rigidity of the sides/surfaces of the hexagonal head 108. At the initial note insertion, the pressure plate 114 is in contact with the bottom of the hexagonal head 108. The pressure plate 114 can create a box, closed at its bottom, which flattens the bottom of the bag to be substantially horizontal. This flat bottom surface 302 improves quality of the stack by keeping banknotes substantially horizontal.

Figure 4B:
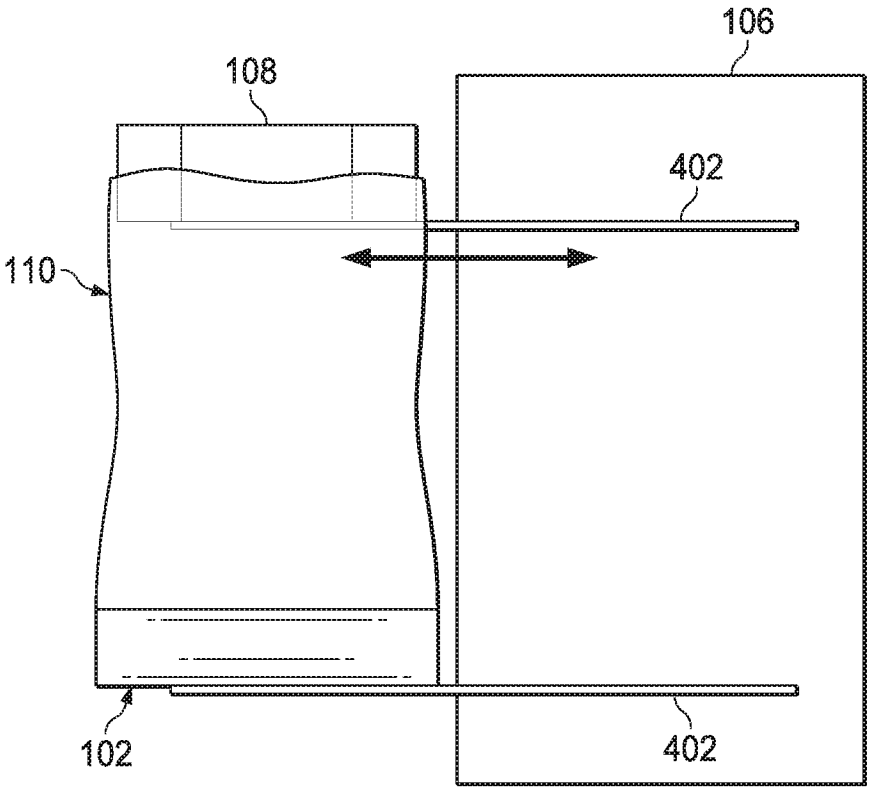
FIGS. 4A and 4B illustrate a hexagonal head and roll of the bag sliding in and out of a safe to improve access of the mechanism according to various embodiments of the present disclosure.
Figure 4A:
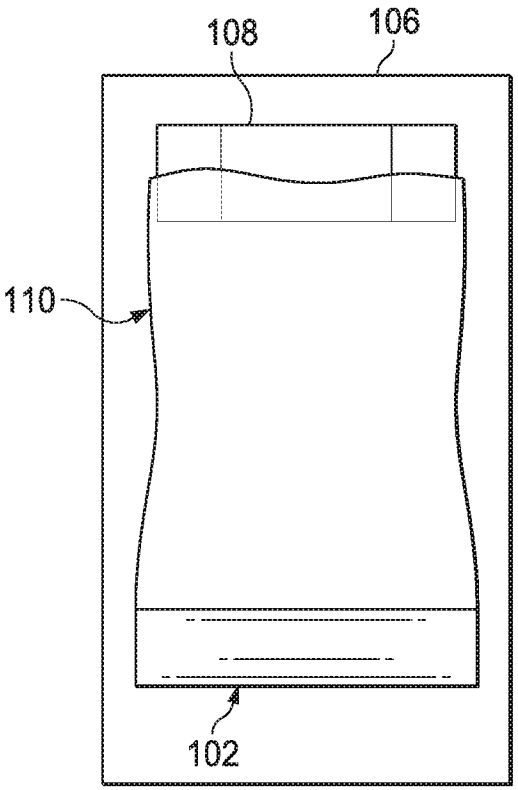
Figures 5A, 5B, 5C, 5D:
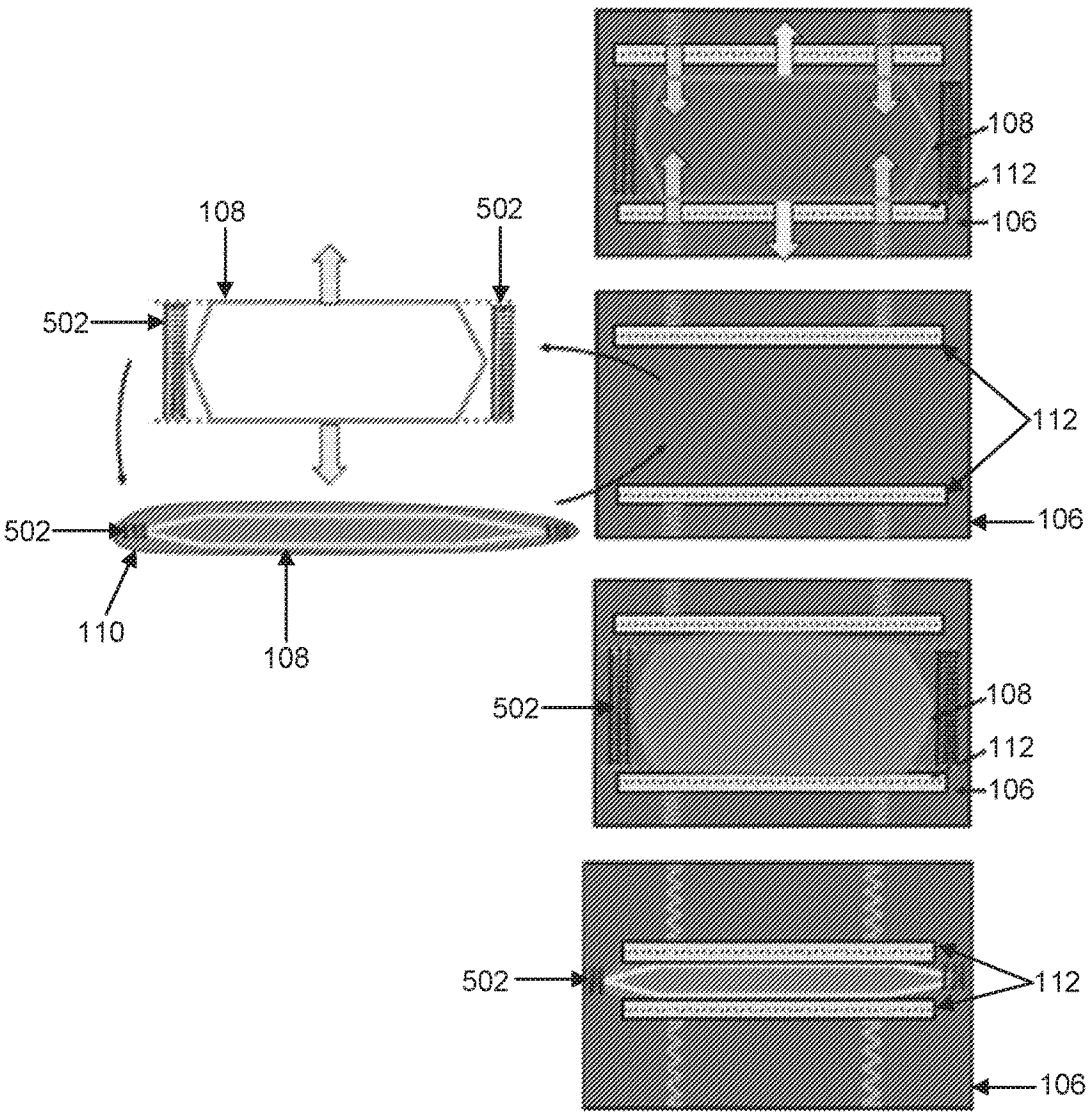
FIGS. 5A-5D illustrate a top view of a schematic of a hexagonal head connected to spring loaded top sealing mechanism according to various embodiments of the present disclosure.

FIGS. 4A and 4B illustrate the hexagonal head 108 and the roll 102 of the bag 110 sliding in and out of the safe 106 to improve access of the mechanism according to various embodiments of the present disclosure. Safes come in a wide variety of configurations, and FIGS. 4A and 4B do not limit this disclosure to any particular implementation of a safe. For example, the bag 110, the hexagonal head 108, and the safe 106 can be part of the sealing system 100 as shown in FIG. 1.

In FIGS. 4A and 4B, the hexagonal head 108 and the bag roll 102 could be mounted on a sliding rail 402 to improve user friendliness. This feature improves access of the CIT personnel and reduces the time used to mount a new bag on the hexagonal head 108.

In FIG. 4B, as the hexagonal head 108 and the bag roll 102 slides out of the safe 106, access to the bag is greatly improved. The additional advantage from having the sliding system results in reduction in size for the safe used, as CAT personnel do not need to access the entire safe 106.

FIGS. 5A-5D illustrate a top view of a schematic of the hexagonal head 108 connected to the spring loaded top sealing mechanism 112 according to various embodiments of the present disclosure. Sealing mechanisms come in a wide variety of configurations, and FIGS. 5A-5D do not limit this disclosure to any particular implementation of a sealing mechanism. For example, the bag 110, the hexagonal head 108, and the sealing mechanism 112 can be part of the sealing system 100 as shown in FIG. 1.

In FIGS. 5A-5D, the top sealing mechanism 112 is connected to the hexagonal head 108. When the sealing mechanism 112 closes, the mechanism also closes the hexagonal head 108 as well as flattens the bag 110 for a better sealing quality.

The hexagonal head 108 can slide in and out of the safe 106 allowing the hexagonal head 108 to selectively engage with the spring loaded top sealing mechanism 112. The hexagonal head 108 comprises at least one spring 502 that keeps the hexagonal head 108 and the bag 110 open during a cash accumulating cycle. After initiation of sealing, the spring loaded top sealing mechanism 112 acts against the spring 502, keeping the hexagonal head 108 and the bag 110 open. As the force used to keep the hexagonal head 108 and the bag 110 open is minimal compared to the force applied by the spring loaded sealing mechanism 112, the hexagonal head 108 closes under the force applied by the spring loaded top sealing mechanism 112. After the hexagonal head 108 is closed, sealing and vacuuming operations begin. Upon completion of sealing and vacuuming, the entire hexagonal head 108 along with the bag roll 102 is pulled out on the rail. After the sealed bag is retrieved by CIT personnel, the personnel can mount anew bag on the closed hexagonal head 108. After the bag is mounted on the closed hexagonal head 108, the spring 502 in the hexagonal head 108 can be used to open the hexagonal head 108 and stretch the bag.

Figure 6A:
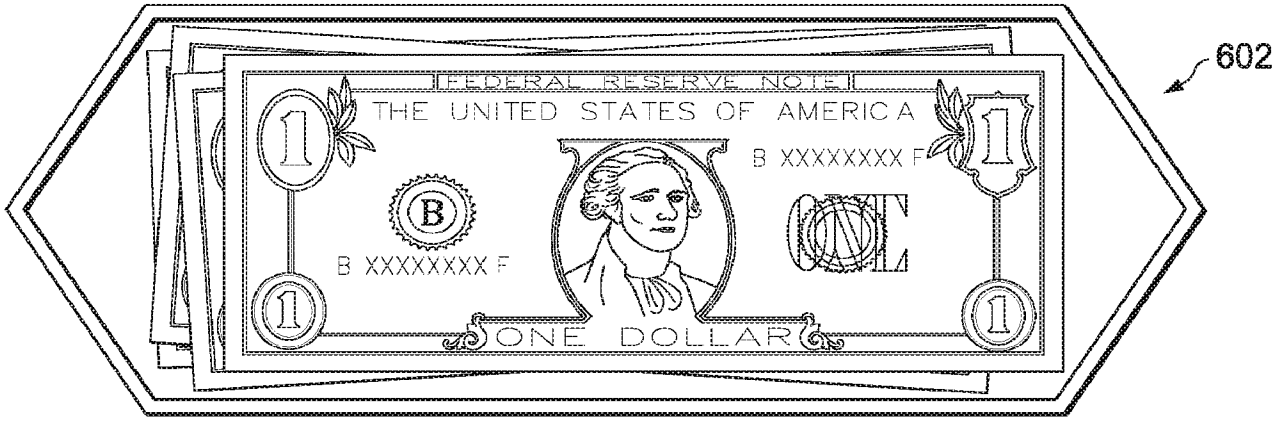
FIGS. 6A and 6B illustrate a hexagonal head made of different sizes to accommodate different denominations of banknotes and/or coupons according to various embodiments of the present disclosure.
Figure 6B:
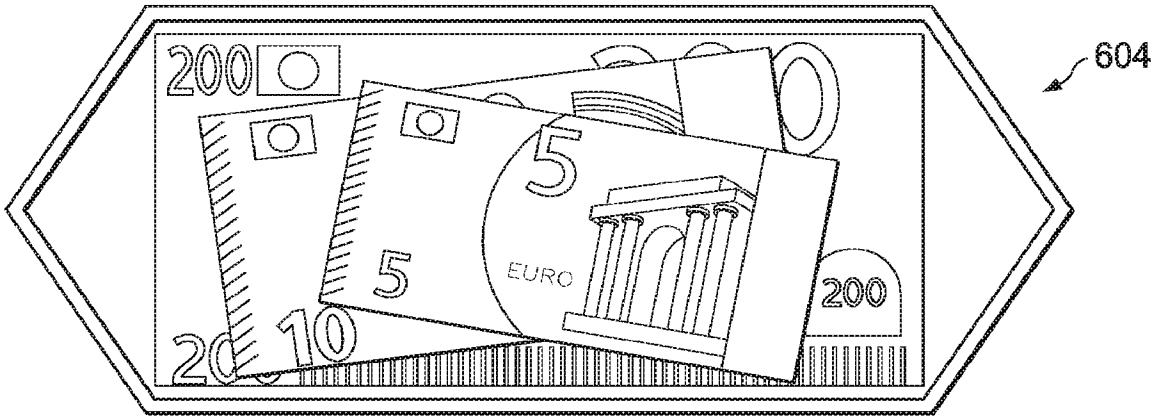

FIGS. 6A and 6B illustrate hexagonal heads made of different sizes to accommodate different denominations of banknotes and/or coupons according to various embodiments of the present disclosure. Hexagonal heads conic in a wide variety of configurations, and FIGS. 6A and 63 do not limit this disclosure to any particular implementation of a hexagonal head. For example, the hexagonal head 602 and the hexagonal head 604 can be part of the sealing system 100 as shown in FIG. 1.

In FIGS. 6A and 6B, the hexagonal head along with the vacuum sealing system can be made specific for country or denomination specific to make the system compact and reduce cost of components.

In FIG. 6A, in one example, a hexagonal head 602 can have one size for US where all the banknote denominations have same size. In another example, such as that illustrated in FIG. 6B, for the countries where size of the banknote varies by denomination such as Euro notes, options of different sizes for a hexagonal head 604 can be explored as customers in some cases may want to either accept or transport only a few of the denominations instead of accepting all banknotes.

The hexagonal head 602 is also compatible with different size bags. As the hexagonal head 602 is adaptable to the denominations, roll size can be changed as well. Different embodiments can also use different roll capacities. The size of the bag can also be adapted to the denomination for a better stack organization and stack management.

Figure 7B:
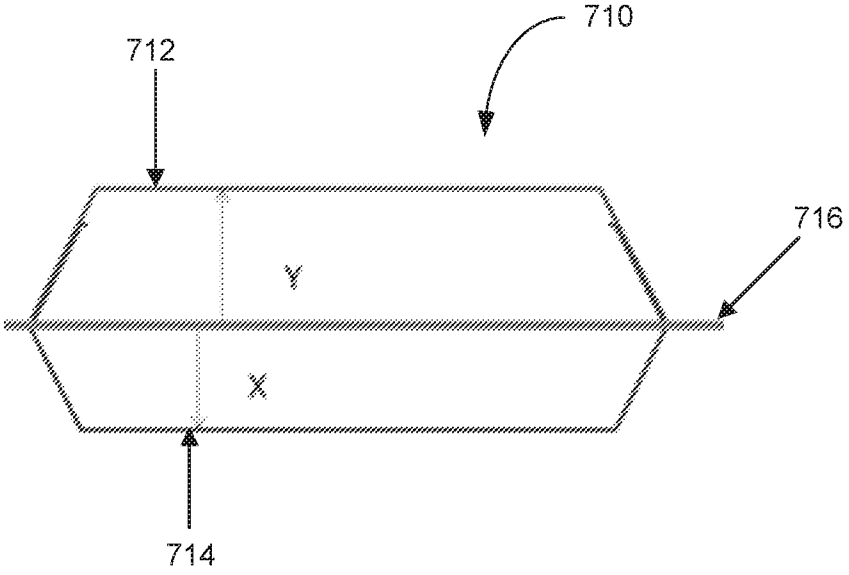
FIGS. 7A and 7B illustrate hexagonal heads with equal and unequal distance from center according to various embodiments of the present disclosure.
Figure 7A:
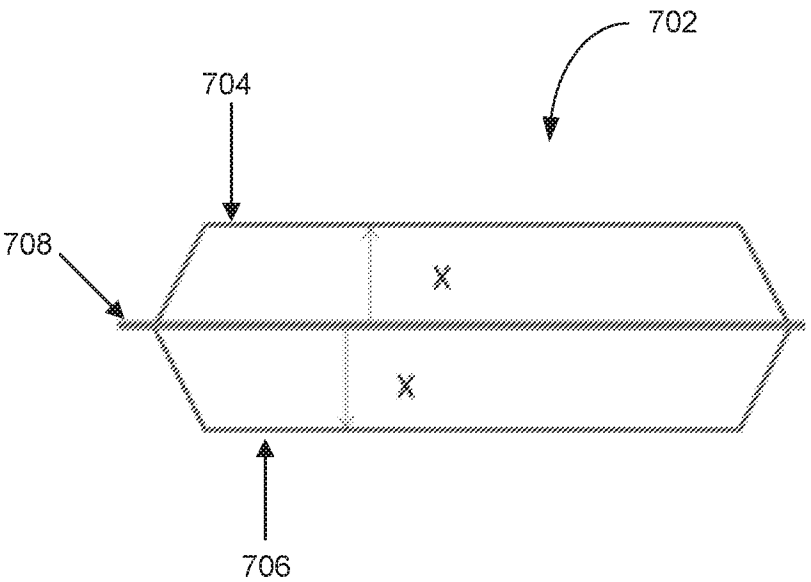

FIGS. 7A and 7B illustrate hexagonal heads with equal and unequal distance from center according to various embodiments of the present disclosure. Hexagonal heads come in a wide variety of configurations, and FIGS. 7A and 7B do not limit this disclosure to any particular implementation of a hexagonal head. For example, the hexagonal head 702 and the hexagonal head 710 can be part of the sealing system 100 as shown in FIG. 1.

FIG. 7A illustrates a hexagonal head 702 including a first parallel side 704 and a second parallel side 706 at an equal distance from a center 708 of the hexagonal head 702. FIG. 7B illustrates a hexagonal head 710 including a first parallel side 712 and a second parallel side 714 at an unequal distance from a center 716 of the hexagonal head 710 according to various embodiments of the present disclosure. Having an unequal distance may provide an advantage in improving stack quality. If the bag used has one side smooth (no texture) and one side with texture, then the texture side may cause banknotes to stick on that side due to higher friction resulting in an inclined (poor quality) stack. For example, the first parallel side 704 of the hexagonal head 702 and the first parallel side 712 of the hexagonal head 710 may be textured sides, while the second parallel side 706 and the second parallel side 714 may be smooth (no texture) sides. By having the textured side further away from the center, the contact of banknotes from the high friction textured side is minimized and stack of banknotes remains substantially horizontal.

As shown in FIG. 7B, distance "Y" is greater than distance "X". In FIG. 7A, the hexagonal head 702 has two "X's" of equal distances from the center 708 while the hexagonal head 710 in FIG. 7B has one "X" and one "Y" of unequal distances from the center 716.

Figure 8C:
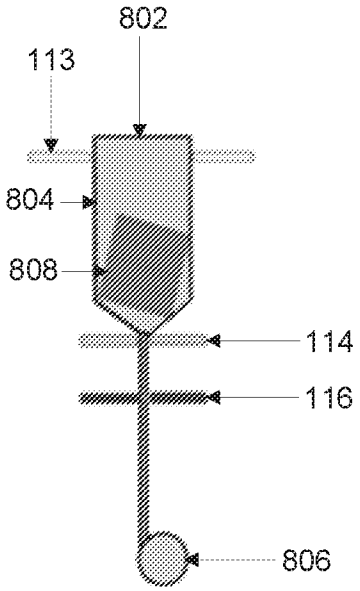
FIGS. 8B and 8C illustrate the operation of a bag with texture/embossing on one side when a pressure plate and lifters move according to various embodiments of the present disclosure.
Figure 8B:
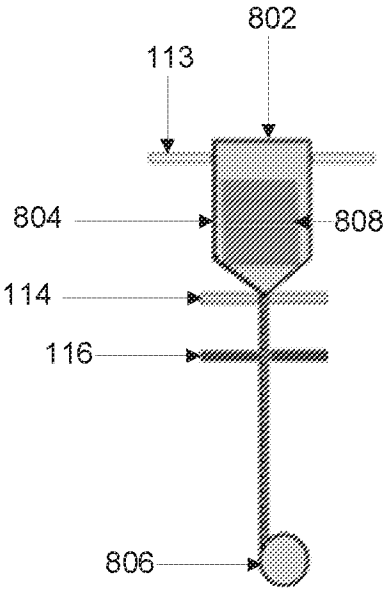
Figure 8A:
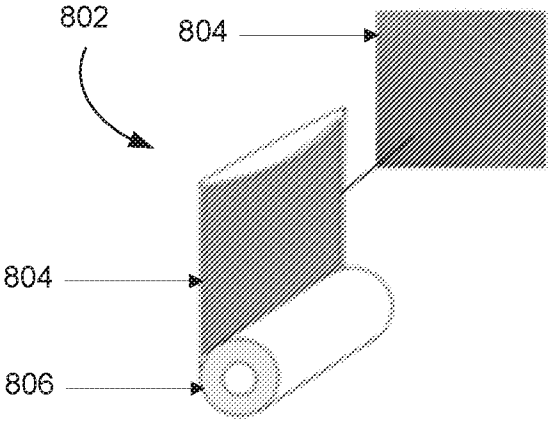
FIG. 8A illustrate a bag with texture/embossing on one side according to various embodiments of the present disclosure.

FIG. 8A illustrates a bag with texture/embossing on one side according to various embodiments of the present disclosure. Bags come in a wide variety of configurations, and FIG. 8A does not limit the scope of this disclosure to any particular implementation of a bag. For example, bag 802 can be used in sealing system 100 as shown in FIG. 1.

In FIG. 8A, the bag 802 may extend from a roll 806 and have only one textured side 804, while the other side is not textured/embossed. The system utilizes a bag with at least one of the sides having texture to improve performance during vacuum.

FIGS. 8B and 8C illustrate the operation of a bag with texture/embossing on one side when the pressure plate 114 and lifters 116 move according to various embodiments of the present disclosure. Bags, pressure plates, and lifter: come in a wide variety of configurations, and FIGS. 8B and 8C do not limit the scope of this disclosure to any particular implementation of bag, pressure plates, and lifters. For example, bag 802, pressure plate 114, and lifters 116 can be used in sealing system 100 as shown FIG. 1.

In FIGS. 8B and 8C, the bag 802 may be attached to the hexagonal head 108. FIG. 8B illustrates the pressure plate 114 and the lifter 116 in a position below banknotes 808 in the bag 802. The pressure plate 114 disposed below the banknotes 808 cause the banknotes 808 to lay flat within the bag 802, in this example. FIG. 8C illustrates the pressure plate 114 and the lifter 116 moving down from the bag 802. The bag 802 includes texture/embossing on at least one side, the textured side 804. If the bag has one side smooth (no texture) and one side with texture, then higher friction on the textured side 804 can result in an inclined stack. For example, as illustrated in FIGS. 8B and 8C, when the pressure plate 114 and the lifters 116 move down, the banknotes 808 fall lower into the bag 802. The banknotes 808 fall into an included stack due to the textured side 804 having a larger coefficient of friction, which causes the sides of the banknotes 808 contacting the textured side 804 to fall at a slower rate than the sides of the banknotes 808 contacting the non-textured side.

Figure 9A:
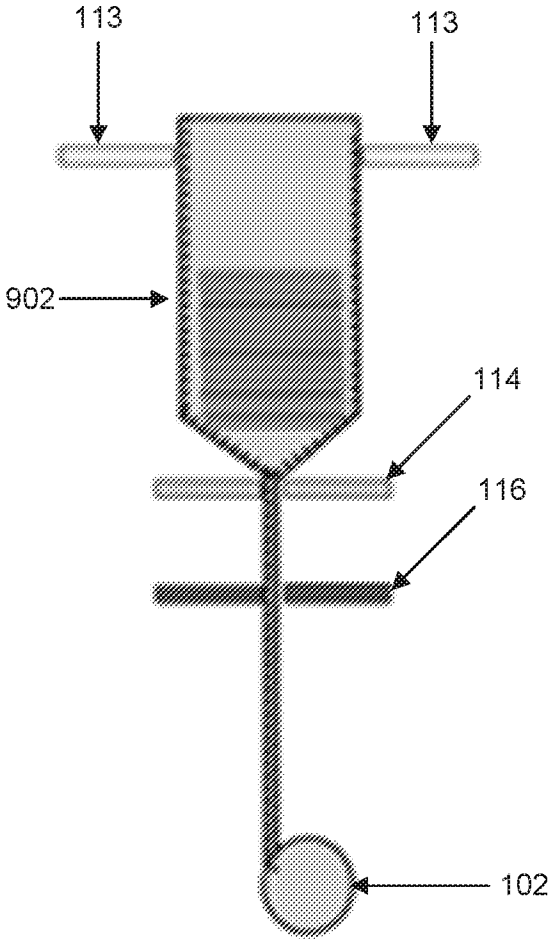
FIGS. 9A and 9B illustrate options to limit a tilt of a stack in a bag due to higher friction of the surface with texture/embossing according to various embodiments of the present disclosure.
Figure 9B:
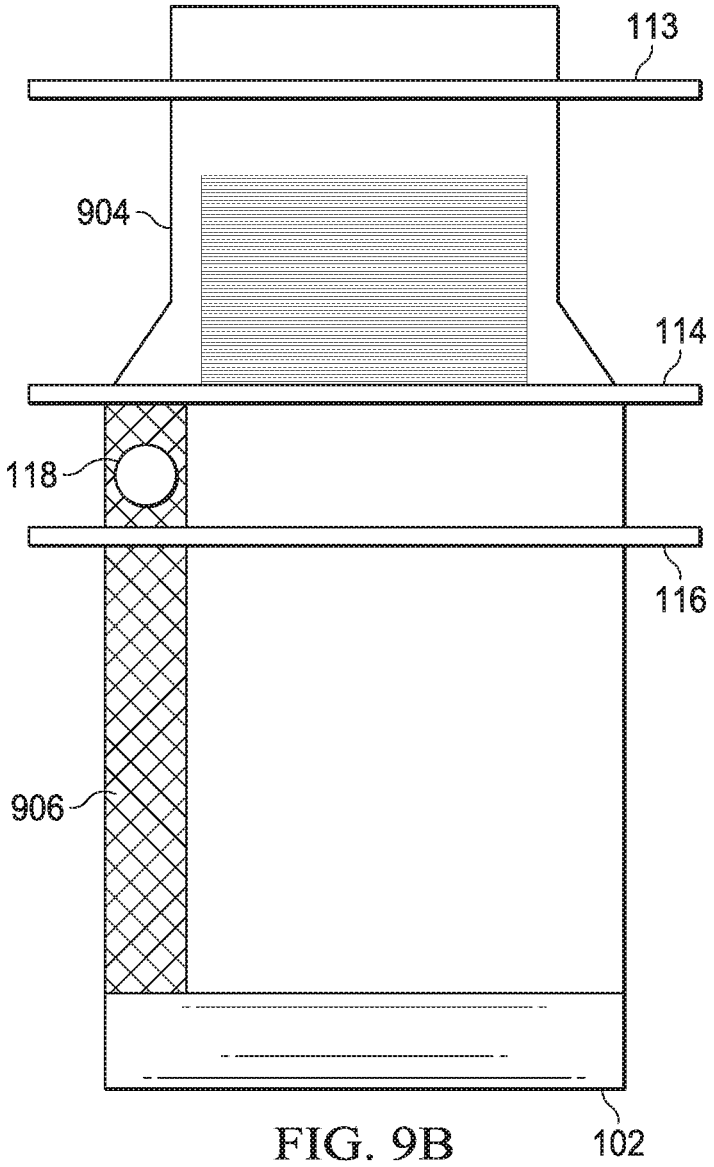

FIGS. 9A and 9B illustrate options to limit a tilt of a stack in a bag due to higher friction of the surface with texture/embossing according to various embodiments of the present disclosure. Bags come in a wide variety of configurations, and FIGS. 9A and 9B do not limit the scope of this disclosure to any particular implementation of a bag. For example, bag 902 can be used in sealing system 100 as shown in FIG. 1.

In FIGS. 9A and 9B, as described in FIG. 8, the texture/embossing on only one side could result in an inclined stack. FIG. 9A illustrates texture/embossing on both sides of a bag 902. FIG. 9A also illustrates arms 113, the pressure plate 114, and lifters 116. FIG. 9B illustrates an example of a bag 904 with texture/embossing on a limited area such as a strip 906 moved to one of sides. The piercing head 118 may also be moved to one of the sides. The arrangement illustrated in FIG. 9B may provide air a way out as well as keep friction constant for banknotes 908 as the banknotes 908 do not initially come in contact with the surface or strip 906 having texture/embossing. In this example, the piercing head 118 may be aligned with the embossed area or strip 906. FIG. 9B also illustrates arms 113, the pressure plate 114, and lifters 115.

One or more embodiments of this disclosure provide a spring loaded top sealing mechanism 112. The top sealing mechanism is positioned just below the hexagonal head 108. The top sealing mechanism 112 may be a spring loaded mechanism that, in an example embodiment, can be opened manually by the CIT personnel during the bag installation. In the embodiment where manual operation is used without a motor, the cost of the system is reduced. If a motor is used then expensive components, like electronic drivers and sensors are used. Moreover, the total power consumption could increase as well.

Figure 10B:
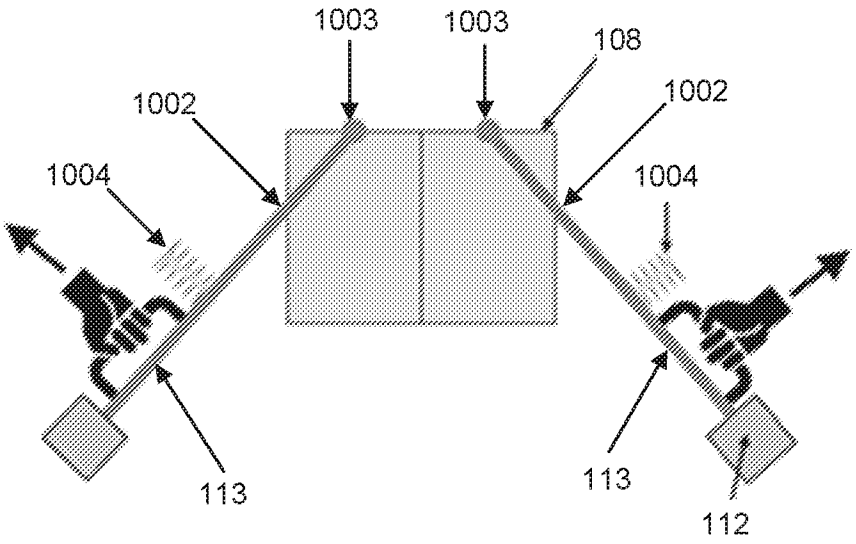
FIGS. 10A and 10B illustrate manual loading of a spring loaded top sealing mechanism according to various embodiments of the present disclosure.
Figure 10A:
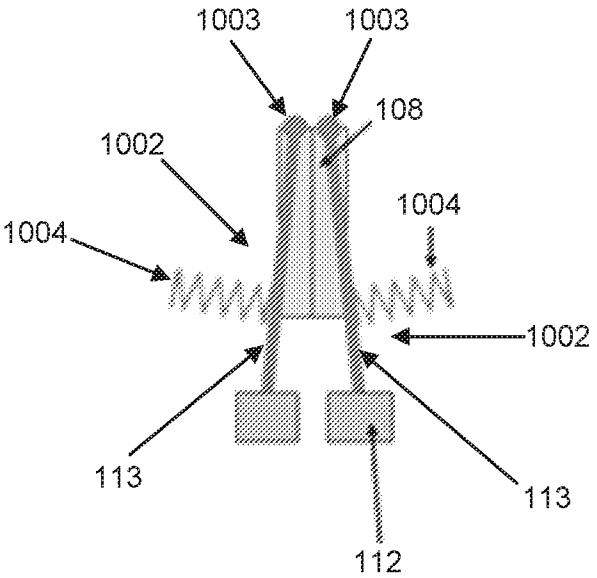

FIGS. 10A and 10B illustrates manual loading of spring loaded top sealing mechanism 112 according to various embodiments of the present disclosure. Sealing mechanisms come in a wide variety of configurations, and FIGS. 10A and 10B do not limit this disclosure to any particular implementation of a sealing mechanism. For example, the sealing mechanism 112 can be part of the sealing system 100 as shown in FIG. 1.

In FIG. 10A, the top sealing mechanism 112 is composed of two sides 1002. A first side becomes rigid at the mechanism closure, and a second side pushes against the first side with the correct force, using a spring 1004, to close a hexagonal head weld the bag by heat.

The operator can open the top sealing mechanism 112 using a lever in front of the safe. FIG. 10B illustrates an operator opening the top sealing mechanism 112. Using this lever, the two sides 1002 (and arms 113, each arm 113 coupled to rotational joint 1003 at a top of the hexagonal head 108) of the heat sealing system open at the same time. Once the heat sealer mechanism is manually opened (and the spring loaded) by the operator, the mechanism is locked in open position by hooks.

Figure 11:
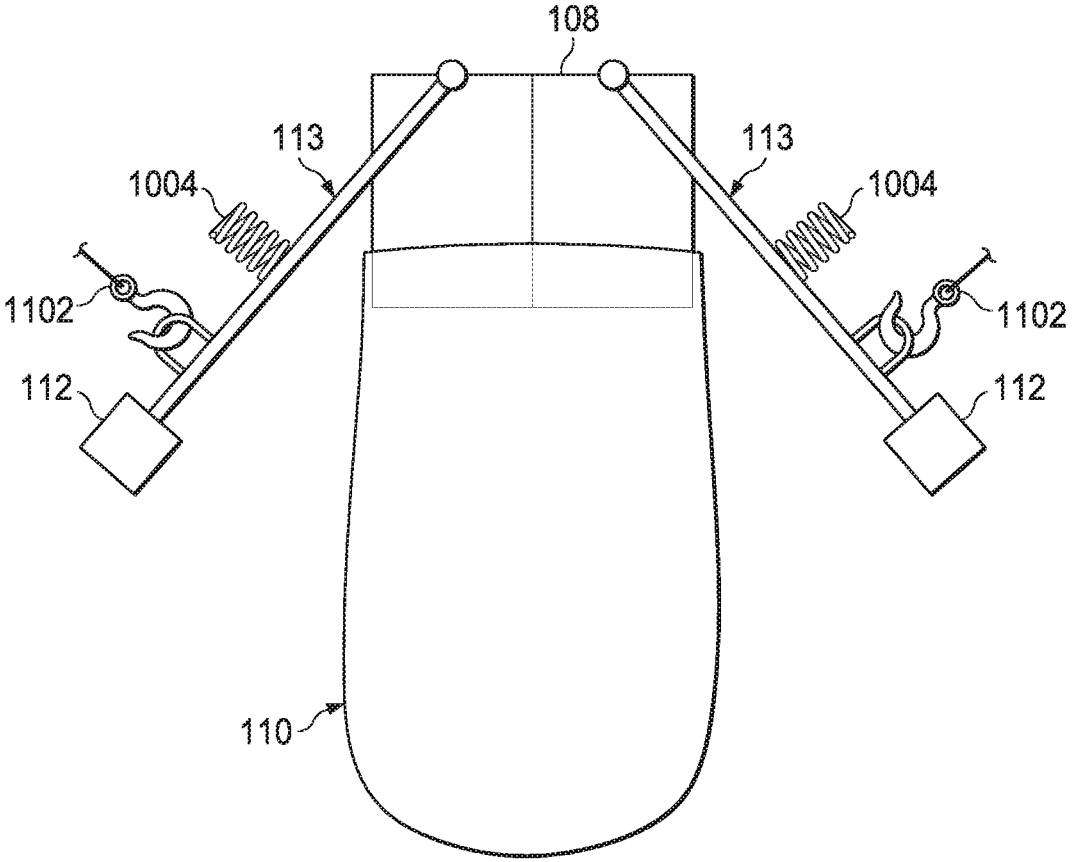
FIG. 11 illustrates loading of hooks to keep arms of a sealing mechanism in an open position according to various embodiments of the present disclosure.

FIG. 11 illustrates loading of hooks 1102 to keep the arms 113 of the sealing mechanism 112 in an open position according to various embodiments of the present disclosure. Sealing mechanisms and hooks come in a wide variety of configurations, and FIG. 11 does not limit this disclosure to any particular implementation of a sealing mechanism or a hook. For example, the sealing mechanism 112 and the hooks 1102 can be part of the sealing system 100 as shown in FIG. 1.

In FIG. 11, when the hooks 1102 are unlocked, the sealing mechanism 112 is released. In one embodiment, both sides of the sealing mechanism 112 are released at the same time. The sealing mechanism 112 then moves back, by itself due to the loaded springs 1004, to close the bag 110 and press the bag 110 to seal it by heat welding. The top sealing mechanism 112 is connected to the hexagonal head 108. When the top sealing mechanism 112 closes, at the same time the hexagonal head 108 is also closed and the bag 110 is flattened for a proper sealing.

Figure 12A:
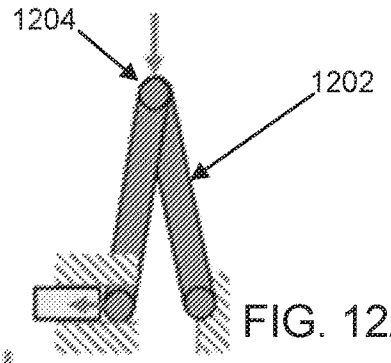
FIGS. 12A-12C illustrate a knee lever mechanism according to various embodiments of the present disclosure.
Figure 12B:
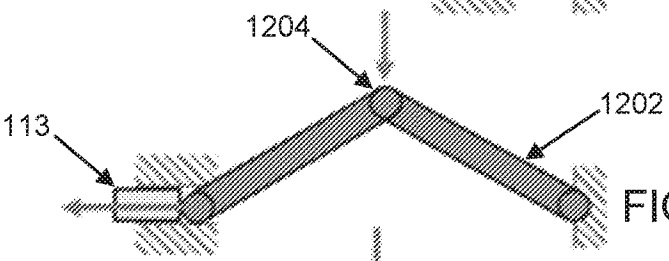
Figure 12C:
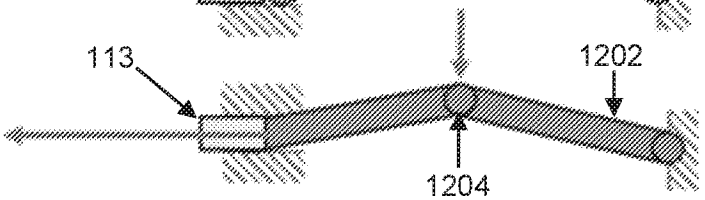

FIGS. 12A-12C illustrate a knee lever mechanism 1202 according to various embodiments of the present disclosure. Knee lever mechanisms come in a wide variety of configurations, and FIGS. 12A-12C do not limit this disclosure to any particular implementation of a knee lever mechanism. For example, knee lever 1202 can be part of the sealing system 100 as shown in FIG. 1.

In FIGS. 12A-12C, one or more embodiments provide that the action of opening of the arms 113 and loading of the springs 1004 is user friendly and does not require an operator to exert a large amount of force. The force to open the arms 113 may be low enough for a user to operate. In one embodiment, the force applied by a spring should be strong enough to properly weld the bag 110 when the arms 113 are closed, and the force should become small when the arms 113 are open.

If a force is applied in a middle 1204 of the knee levers 1202, then the force is amplified when the knee lever 1202 becomes almost horizontal as shown in FIG. 12C (the angle between lever is almost equal to 180°). For the same reason, when the angle between levers is small the force applied is reduced until to achieve zero when the angle is low. To easily open a knee lever mechanism, instead to pushing the extremity (the arm 113), it is easier to pull the middle 1204 of the knee lever.

Various embodiments of this disclosure use a knee lever to amplify the force of the spring 1004 when the sealing mechanism 112 is closed and to strongly reduce the force applied by the arms 113 when the sealing mechanism 112 is open. The CIT operator may, in some embodiments, open the sealing mechanism 112 using a lever in front of the safe 106 that will pull back the levers in the middle of the knee.

Figure 13:
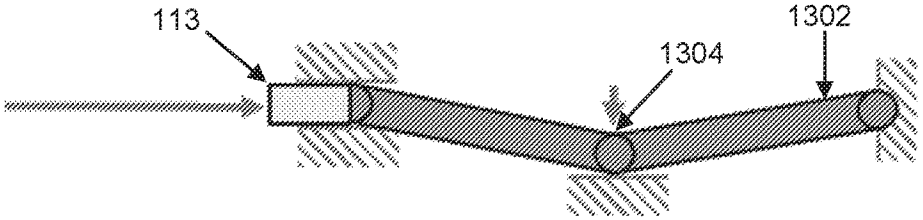
FIG. 13 illustrates a knee lever mechanism in a blocked position on a reference side of a sealing mechanism according to various embodiments of the present disclosure.

FIG. 13 illustrates a knee lever mechanism 1302 in a blocked position on a reference side according to various embodiments of the present disclosure. Knee lever mechanisms come in a wide variety of configurations, and FIG. 13 does not limit this disclosure to any particular implementation of a knee lever mechanism. For example, knee lever 1302 can be part of the sealing system 100 as shown in FIG. 1.

In FIG. 13, the top sealing mechanism 112 is composed of two sides. One side becomes rigid at the mechanism closure acting as a reference, and a second side pushes against with the correct force (using a spring) to weld the bag by heat.

The side that is rigid at its closure also uses the knee lever mechanism 1302. If the knee lever 1302 surpasses the horizontal state and if a middle 1304 of the knee lever 1302 is blocked on a fixed point below the horizontal line, then the system becomes rigid and self-blocked. A small pull back spring may be used to move the knee lever 1302 until the blocked position.

Figure 14A:
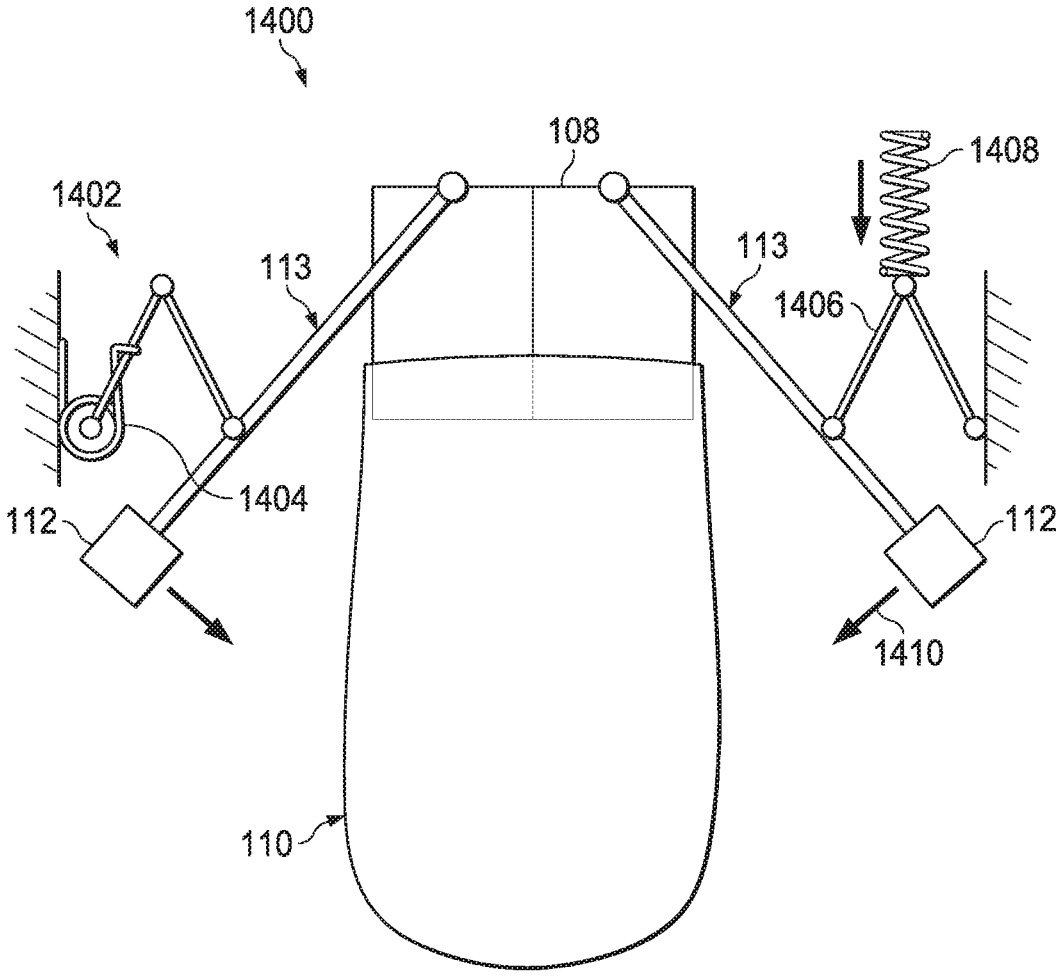
FIG. 14A illustrates a spring loaded top sealing mechanism with knee levers according to various embodiments of the present disclosure.
Figure 14B:
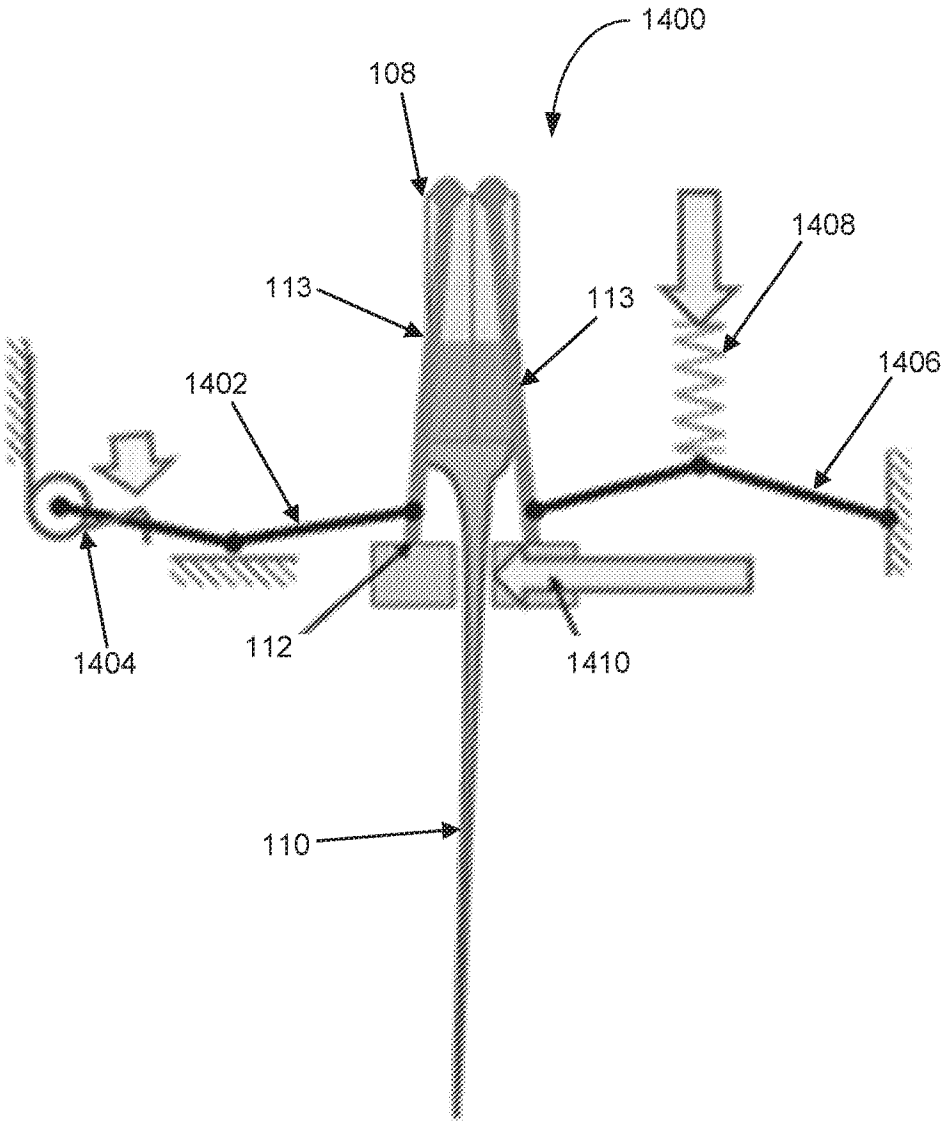
FIG. 14B illustrates a closed state of a spring loaded top sealing mechanism with knee levers according to various embodiments of the present disclosure.

FIGS. 14A and 14B illustrate a spring-loaded top sealing mechanism 1400 with knee levers according to various embodiments of the present disclosure. Sealing mechanisms and knee levers come in a wide variety of configurations, and FIGS. 14A and 14B do not limit this disclosure to any particular implementation of a sealing mechanism or knee levers. For example, sealing mechanism 1400 and knee levers 1402 and 1406 can be part of the sealing system 100 as shown in FIG. 1.

In FIGS. 14A and 14B, FIG. 14A illustrates an open position and FIG. 14B illustrates a closed position. The top sealing mechanism 1400 can use these two principles on the arms 113 as shown on in FIGS. 14A-14B. One advantage allows use of a less strong spring which provides an easier way to open the mechanism because less force is used when the sealing mechanism 1400 is disengaged. The maximum force is obtained when needed the most, at a closed state. A first lever 1402 is disposed on a first side of the sealing mechanism 112. A small pull back spring 1404 may be used to move the lever 1402 until a blocked position, such as that described with respect to FIG. 13 and as shown in FIG. 14B.

A second lever 1406 is disposed on a second side of the sealing mechanism 1400. A strong enough force 1410 is applied by a spring 1408 to properly weld the bag 110 when the arms 113 are closed, and the force should decrease when the arms 113 are open.

Figure 15:
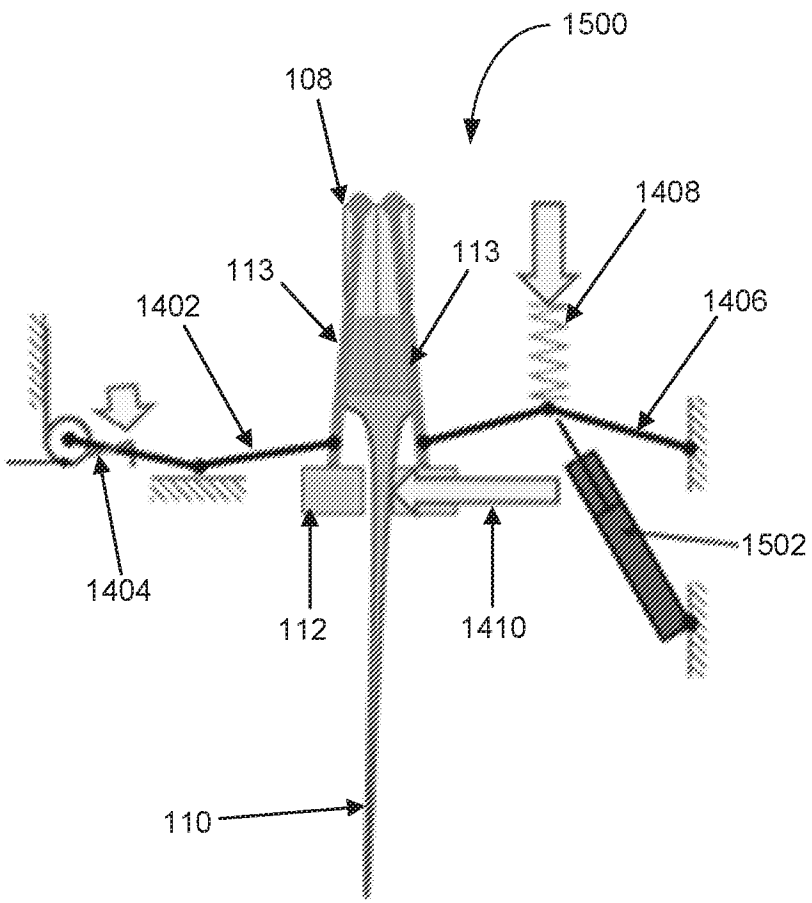
FIG. 15 illustrates a spring loaded top sealing mechanism with knee levers and a damper according to various embodiments of the present disclosure.

FIG. 15 illustrates a spring loaded top sealing mechanism 1500 with knee levers and a damper 1502 according to various embodiments of the present disclosure. Sealing mechanisms, knee levers, and dampers come in a wide variety of configurations, and FIG. 15 does not limit this disclosure to any particular implementation of a sealing mechanism or knee levers. For example, sealing mechanism 1500, knee levers 1402 and 1406, and damper 1502 cats be part of the sealing system 100 as shown in FIG. 1.

In FIG. 15, the knee levers may be arranged in accordance with various embodiments of the present disclosure, such as that described with respect to FIGS. 14A and 14B. When the hooks 1102 are unlocked, it releases the sealing mechanism 1500, but the speed of the closing movement could be very high. This is why a damper, such as, but not limited to, a shock absorber or a hydraulic speed controller can be used to slow down the movement of the heat seal. Once the hooks 1102 have been unlocked, due to the speed controller, the side of the sealing mechanism 1500 with the power spring 1408 and lever 1406 moves slower than the other side (the self-blocking side) with the lever 1402. The self-blocking side can be in the blocked position before the side with the spring 1408 arrives. The bag 110 can then be pushed against the self-blocked side by the side with the spring 1408.

Figure 16:
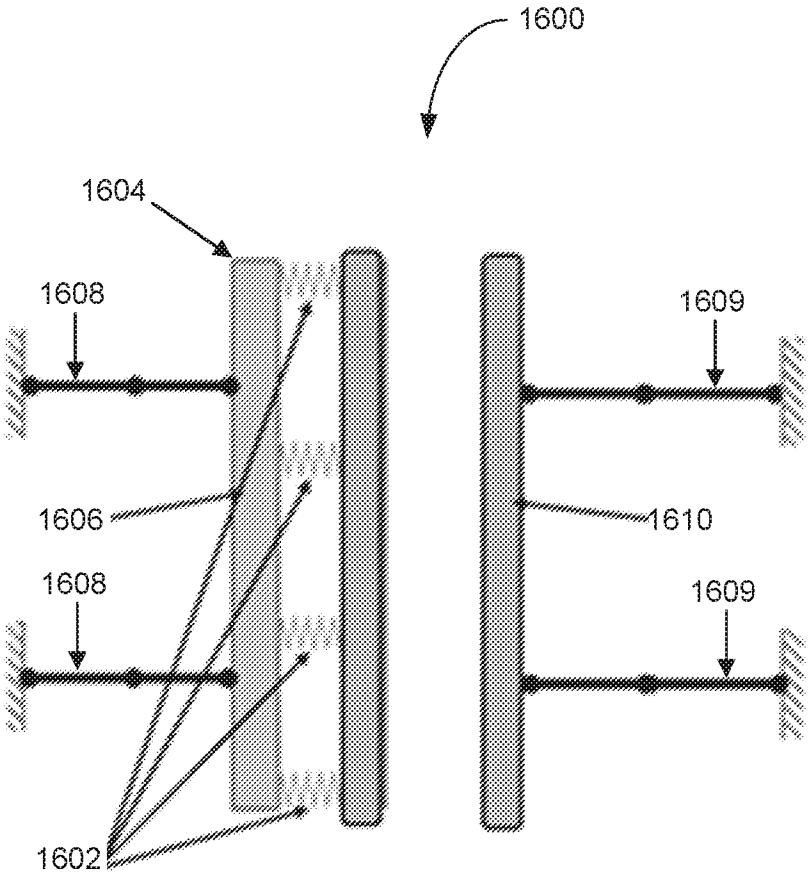
FIG. 16 illustrates a spring loaded top sealing mechanism including compression springs in accordance with various embodiments of the present disclosure.

FIG. 16 illustrates a spring loaded top sealing mechanism 1600 including compression springs in accordance with various embodiments of the present disclosure. Sealing mechanisms and springs come in a wide variety of configurations, and FIG. 16 does not limit this disclosure to any particular implementation of a sealing mechanism or spring. For example, sealing mechanism 1600 and compressions springs 1602 can be part of the sealing system 100 as shown in FIG. 1.

In FIG. 16, force applied by the springs may be homogenized from the self-blocking side by using additional compression springs 1602 all along the self-blocking side between a first arm 1604 and a second arm 1606. This may increase seal quality of the top welding during the vacuum phase. Knee levers 1608 on the self-blocking side extend the first arm 1604 and the second arm 1606 towards a third arm 1610 on the spring loaded side. Knee levers 1609 may also extend the third arm 1610 towards the first arm 1604 and the second arm 1606. When the second arm 1606 comes into contact with the third arm 1610, the springs between the first arm 1604 and the second arm 1606 are compressed across the length of the second arm 1606, applying an equal force across the length of the second arm 1606 against the third arm 1610.

Figure 17B:
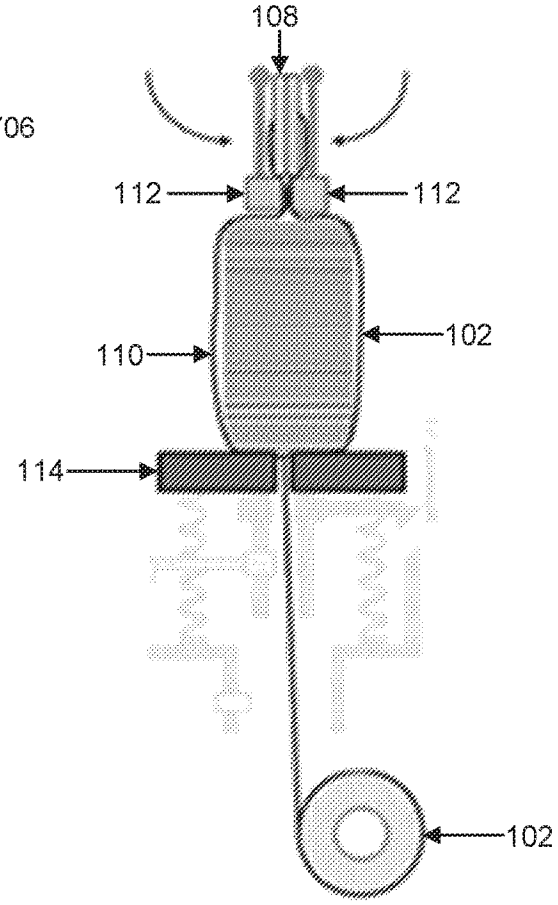
FIG. 17B illustrates the spring loaded top sealing mechanism in a closed position after hooks are actuated by a solenoid in accordance with various embodiments of the present disclosure.
Figure 17A:
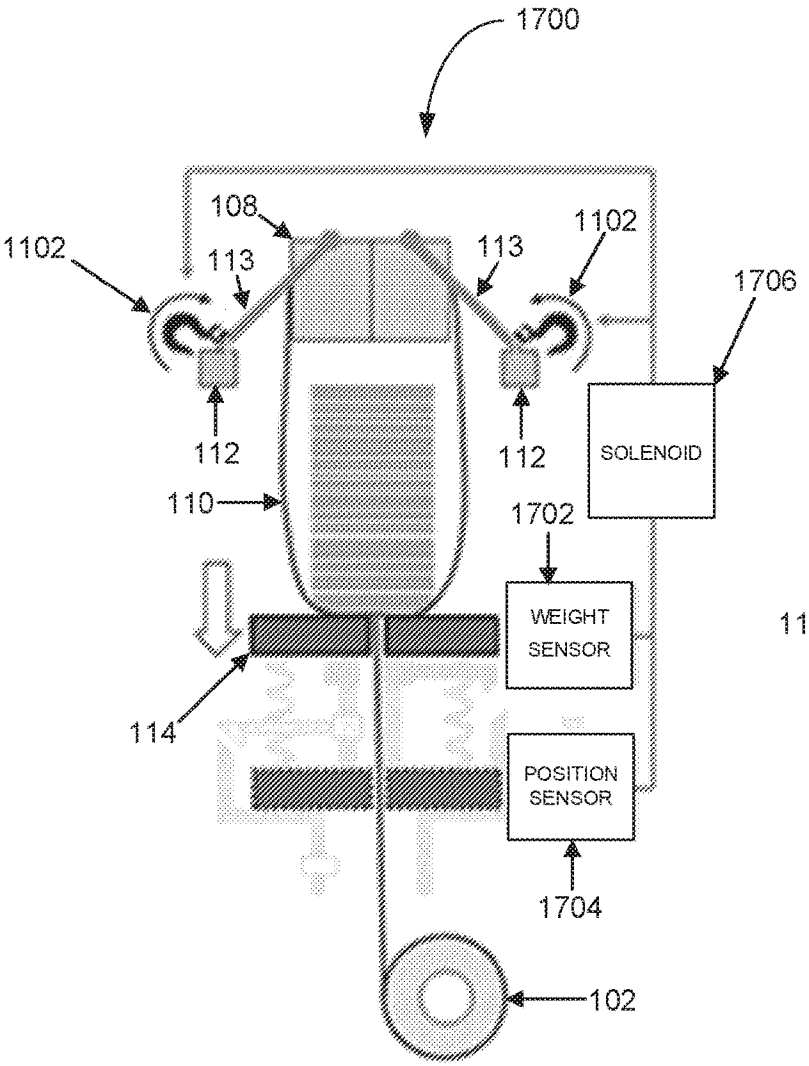
FIG. 17A illustrates sensors and a solenoid used to a trigger a spring loaded top sealing mechanism according to various embodiments of the present disclosure.

FIG. 17A illustrates sensors and a solenoid used to a trigger a spring loaded top sealing mechanism 1700 according to various embodiments of the present disclosure. Sealing mechanisms, sensors, and solenoids come in a wide variety of configurations, and FIG. 17A does not limit this disclosure to any particular implementation of a sealing mechanism, sensor, or solenoid. For example, sealing mechanism 1700, weight sensor 1702, position sensor 1704, and solenoid 1706 can be part of the sealing system 100 as shown in FIG. 1.

In FIG. 17A, in applications where there could be a limit on what CIT can carry at a time, a weight sensor 1702 connected with the pressure plate 114, or a position sensor 1704 connected with the lifter can initiate the sealing mechanism.

Different embodiments can use different options to unlock the hook to close the top sealing. Unlocking the hooks 1102 could be actuated by a solenoid 1706 as shown in FIG. 17. A decision to close the top sealer may be reached by measuring the banknote stack weight on the pressure plate 114 by the weight sensor 1702 or by detecting the position of lifter (the stack height) by the position sensor 1704. A mechanical system may be used that moves depending on the stack height or weight, and that actuates directly the hooks 1102 without a solenoid.

FIG. 17B illustrates the spring loaded top sealing mechanism 1700 in a closed position after the hooks 1102 are actuated by the solenoid 1706. Sealing mechanisms, hooks, and solenoids come in a wide variety of configurations, and FIG. 17B does not limit this disclosure to any particular implementation of a sealing mechanism, hooks, or solenoids. For example, sealing mechanism 1700, solenoid 1706, and hooks 1102 can be part of the sealing system 100 as shown in FIG. 1.

In FIG. 17B, the spring loaded top sealing mechanism 1700 closes around a top of the bag 110 to seal the top of the bag 110 by heating the area of the bag between the arms of the spring loaded top sealing mechanism 1700.

One or more embodiments of this disclosure provide for a multipurpose spring loaded stack organizer. The organizer enables compression of the stack, piercing the bag, and applying the sealer and the vacuum with a single moving part to trigger these different events, making this implementation very cost effective.

Figure 18:
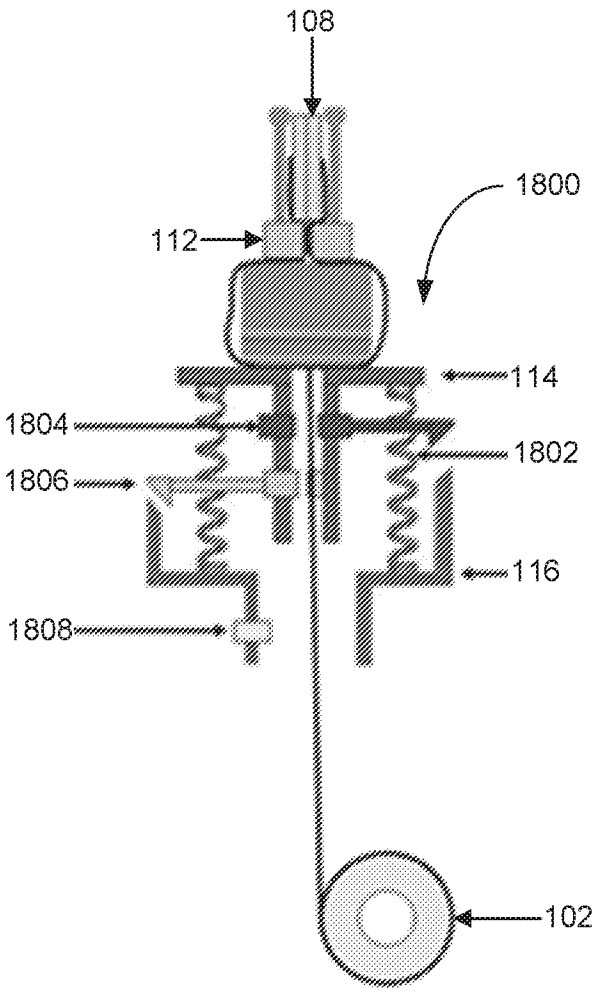
FIG. 18 illustrates a multipurpose spring loaded stack organizer according to various embodiments of the present disclosure.

FIG. 18 illustrates a multipurpose spring loaded stack organizer 1800 according to various embodiments of the present disclosure. Stack organizers come in a wide variety of configurations, and FIG. 18 does not limit this disclosure to any particular implementation of a stack organizer. For example, stack organizer 1800 can be part of the sealing system 100 as shown in FIG. 1.

In FIG. 18, the multipurpose spring loaded stack organizer 1800 may be the multipurpose spring loaded stack organizer 104. As shown in FIG. 18, the multipurpose spring loaded stack organizer 1800 comprises the pressure plate 114 supporting the bag 110, a set of pre-loaded springs 1802 at a specific weight (such as, but not limited to, twenty kilogram), a heat sealer 1804 (which may be part of the bottom sealing mechanism 120), a vacuum head 1806 which may be the same as the piercing head 118, a bag cutter 1808, and a pair of lifters 116. This multipurpose spring loaded stack organizer 1800 could also comprise a mechanism to hold the bag 110 in place after the bag 110 is cut. The multipurpose spring loaded stack organizer 1800 could be connected with the spring loaded top sealing mechanism 112 and/or the hexagonal head 108.

The bag is pulled through the lifters 116, the bag cutter 1808, the vacuum head 1806 with bag piercing system, the heat sealer 1804, pressure plate 114 and spring loaded top sealing mechanism 112 mounted on the hexagonal head 108. The pressure plate 114 supports a bottom of the banknote stack accumulated in the bag 110. This pressure plate permits the bag 110 to be used without any additional holes or reinforcement. As the bag 110 is mounted on the hexagonal head 108 with either a magnet or fly, the weight of the stack could puncture the bag 110. Introduction of the pressure plate 114 supports the additional weight of the bag 110, permitting use of bag 110 without reinforcement to enhance strength and thereby reducing cost of the bag 110. The pressure plate 114 also provides a fixed drop height for freefalling bills, while allowing for the ability to match the bag size to a required volume of bills and fill size.

FIGS. 19A-19I illustrate the multipurpose spring loaded stack organizer 1800 in operation according to various embodiments of the present disclosure. Stack organizers come in a wide variety of configurations, and FIGS. 19A-19I do not limit this disclosure to any particular implementation of a stack organizer. For example, stack organizer 1800 can be part of the sealing system 100 as shown in FIG. 1.

Figure 19A:
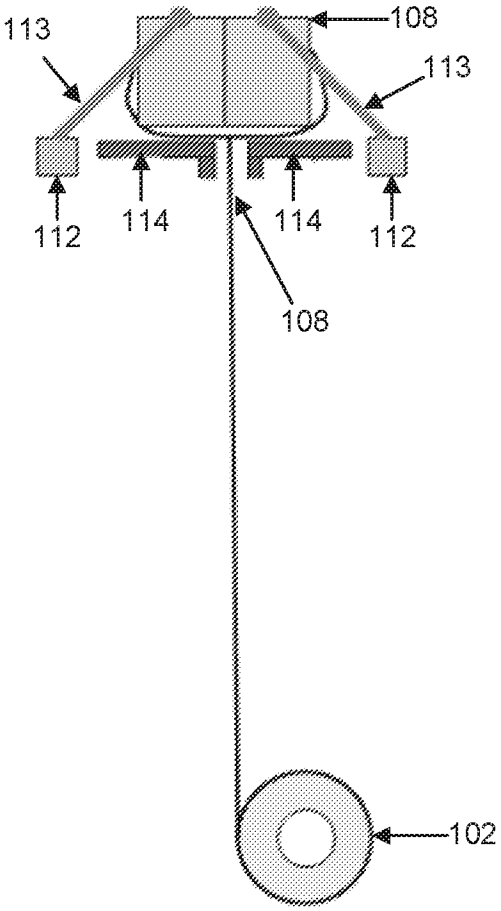
FIGS. 19A-19I illustrate a multipurpose spring loaded stack organizer in operation according to various embodiments of the present disclosure.
Figures 19B, 19C, 19D, 19E:
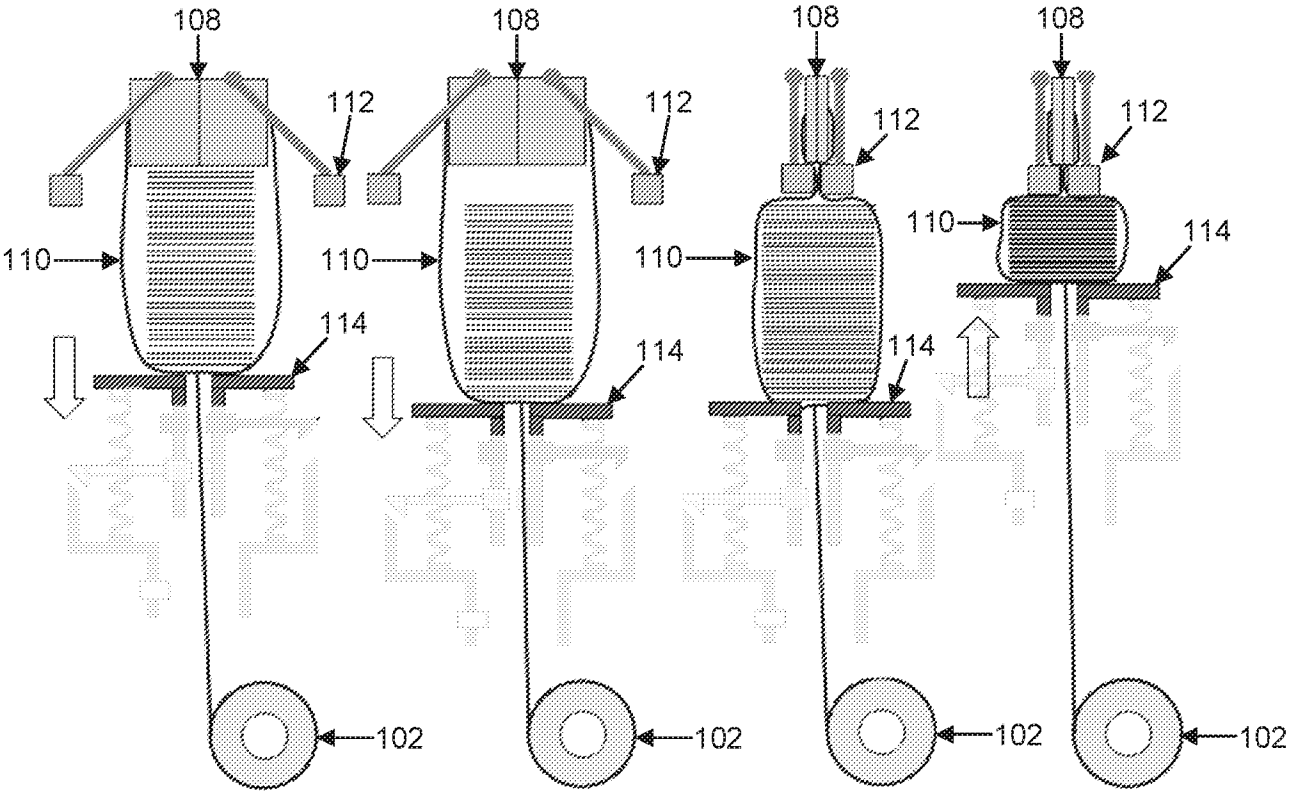

In FIGS. 19A-19I, as illustrated in FIG. 19A, the pressure plate 114 may be positioned directly below a newly installed bag 110 from the roll 102 and below the hexagonal head 108. The sealing mechanism 112 may be in an open position. As illustrated in FIG. 19B, the multipurpose spring loaded stack organizer 1800, during a cash accumulating cycle, moves the accumulated stack down progressively. This allows the top to remain at a relatively constant distance from the note drop chamber 124 keeping the distance individual banknotes have to travel relatively short and on a mostly consistent path, improving operation of the system. Here, the consistent path creates predictable behavior of the banknote entering into the system as all the banknotes travel roughly similar distance. This prevents banknotes turning over, or flying around and sticking to one of the sides, thereby reducing quality of the stack.

In addition, the multipurpose spring loaded stack organizer 1800 could also be used to vibrate the lifter 116 and pressure plate 114 to shake the stack. This shacking can reorganize the banknotes and improve the stack quality.

In addition to moving and organizing the stack during the operation, the multipurpose spring loaded stack organizer 1800 can also assist in the sealing of the bag 110. After initiating the sealing process, the lifter moves down to provide clearance for the spring loaded top sealing mechanism 112, as illustrated in FIG. 19C. Once there is enough clearance, the arms of the spring loaded sealing mechanism 112 swing to close the top of the bag 110, as illustrated in FIG. 19D. The top of the bag 110 is flattened by the hexagonal head 108 that also is flattened. When the force of the lifter 116 equalizes the preloaded compression force of the stack, the lifter 116 will come closer to the pressure plate 114, causing the pressure plate 114 to move back up and compress the banknote stack. In addition, this compression of the stack also pushes the extra air out of the bag 110. This removal of extra air from the bag 110 reduces the need to have a large vacuum pump. The springs 1802 help achieve a minimum of a specific weight (such as, but not limited to, twenty kilograms) of stack compression.

After the extra air is removed from the bag 110, the spring loaded top sealing mechanism 112 welds the top of the bag 110. This connection between the movement of the lifter 116 and the spring loaded top sealing mechanism 112 can be synchronized by using electromechanical, optical, electronic or mechanical relays or sensors.

Figure 19G:
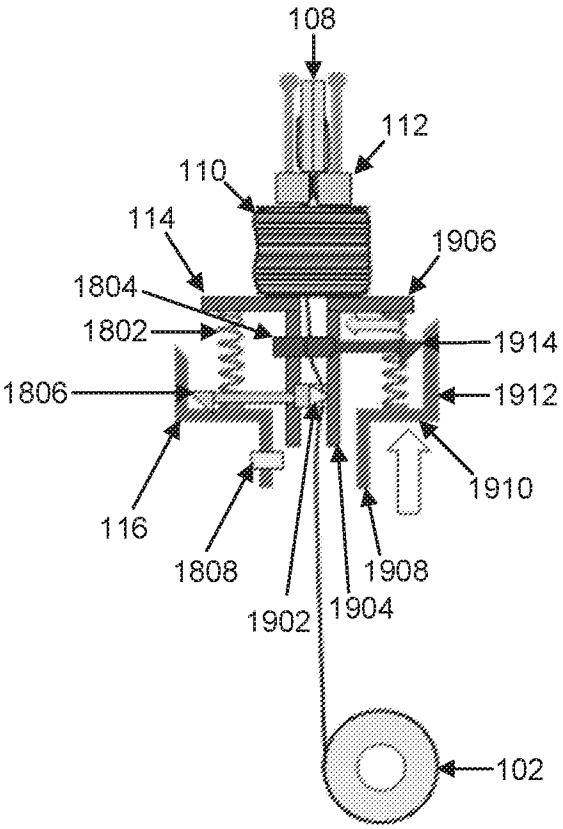
Figure 19F:
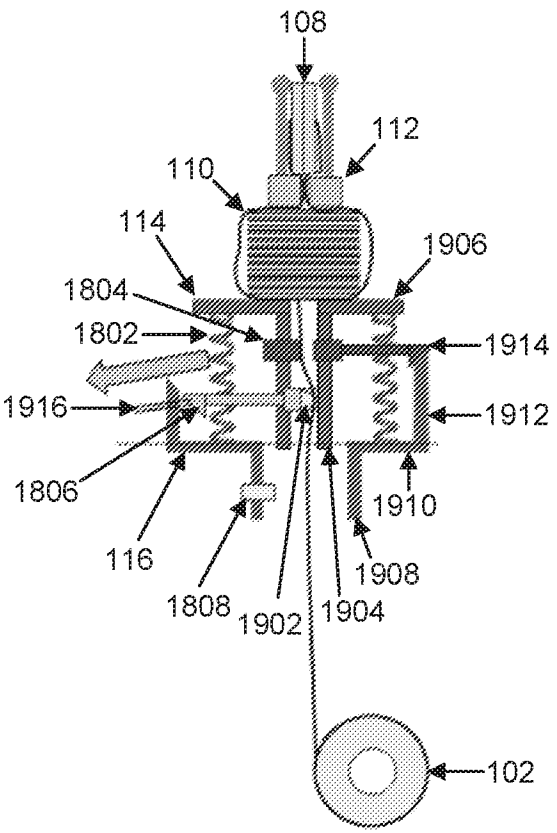

As illustrated in FIG. 19F, the lifters 116 move up and activate the vacuum head 1806 with a bag piercing system, and may include blade 1902. The lifters 116 and the pressure plate 114 may be shaped such that the lifters 116 and the pressure plate 114 turn at right angles. The pressure plate 114 may have a two vertical portions 1904 extending up alongside a portion of the length of the bag 110 from the roll 102. The vertical portions 1904 end upon meeting two horizontal portions 1906 of the pressure plate 114, creating right angles at the points where the vertical portions 1904 and the two horizontal portions 1906 meet. The two horizontal portions 1906 extend out in opposite directions from the center of the multipurpose spring loaded stack organizer 1800, away from the bag 110, providing a platform for the bag and banknote stack to sit on the pressure plate 114.

First vertical portions 1908 of the lifters 116 extend up along at least a portion of the length of the bag 110 from the roll 102. The first vertical portions 1908 end upon meeting horizontal portions 1910 of the lifters 116, creating right angles at the points where the first vertical portions 1908 and the horizontal portions 1910 meet. The horizontal portions 1910 extend out in opposite directions from the center of the multipurpose spring loaded stack organizer 1800, awayfrom the bag 110. The springs 1802 may be disposed against and between the two horizontal portions 1906 of the pressure plate 114, and the horizontal portions 1910 of the lifters 116. Second vertical portions 1912 of the lifters 116 extend up from the ends of the horizontal portions 1910. When the lifters 116 overpass the preloaded force of the springs 1802, the lifters may move up and cause the vacuum head 1806 to be pushed in towards the bag 110 by one of the second vertical portions 1912. The second vertical portion 1912 that contacts the vacuum head 1806 may be shorter in length than the other second vertical portion 1912, as the other second vertical portion 1912 may contact with a heat sealer head 1914 for actuating the heat sealer 1804.

The ends of the second vertical portions 1912 may be cut at an angle, and the vacuum head 1806 and the heat sealer head 1914 may be also have angled surfaces so that, when the second vertical portions 1912 meet the vacuum head 1806 or the heat sealer head 1914, the vacuum head 1806 and the heat sealer head 1914 slide down the second vertical portions 1912 and are pushed in towards the bag 110.

When the vacuum head 1806 is pushed in towards the bag 110 by the lifters 116, the blade 1902 may contact the bag 110. The blade 1902 punctures the bag 110 and holds the bag 110 in place. Vacuum tubing 1916 attached to the vacuum head 1806 allows for a vacuum to pull air from the bag 110. As illustrated in FIG. 19G, when one of the second vertical portions 1912 of the lifters 116 contact the heat sealer head 1914 the heat sealer 1804 is closed and heat is applied to the top of the bag 110 to weld the bag 110 closed.

Figure 19I:
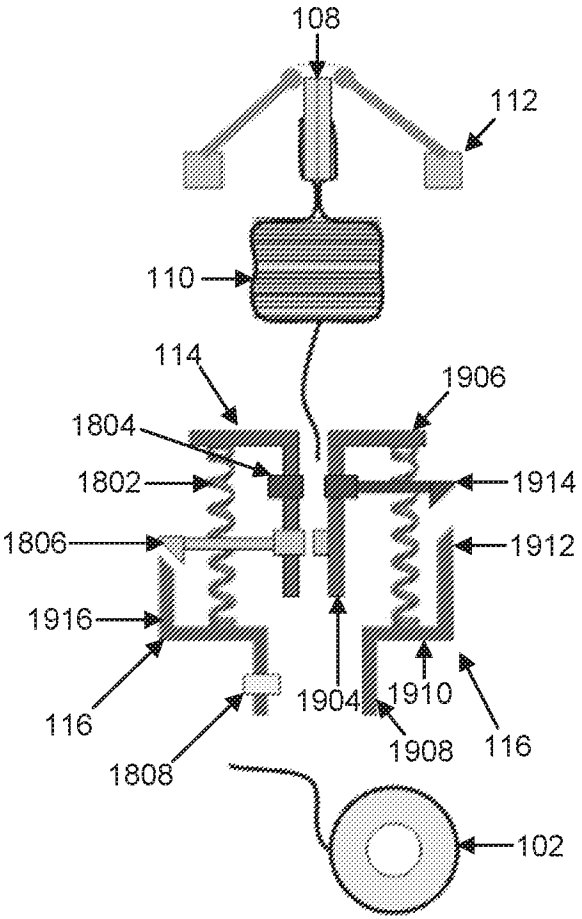
Figure 19H:
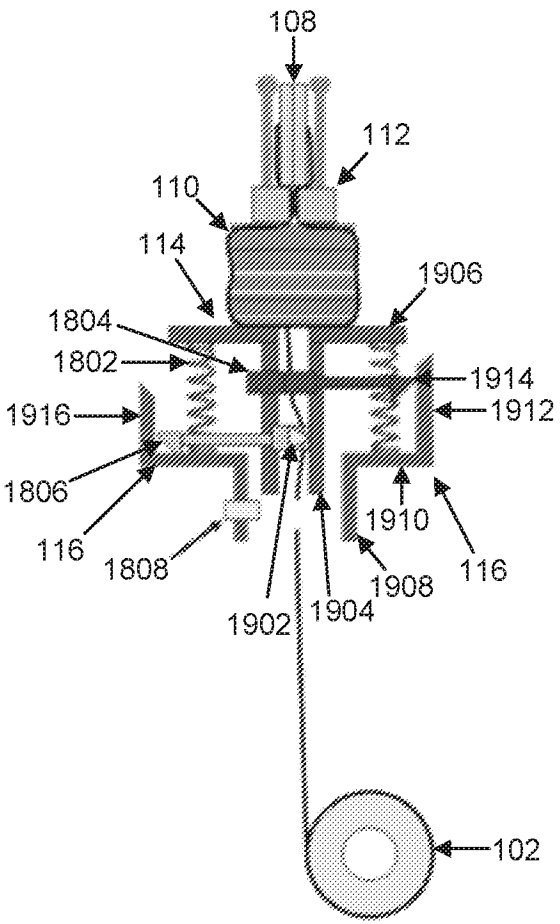

Once the bag 110 is closed, the bag may e cut from the roll 102 and removed from the rapid vacuum sealing system 100, as illustrated in FIGS. 19H and 19I. The bag cutter 1808 may be used to cut the bag 110, either automatically or manually by CIT personnel. The bag cutter 1808 may include a thin blade capable of cutting through the bag 110 as the bag 110 is pulled against the bag cutter 1808. This frees the sealed bag from the rest of the roll 102, allowing the sealed bag of banknotes to be removed and a new bag installed on the hexagonal head 108 from the roll 102. Once the bag 110 is cut, the pressure plate 114 and the lifters 116 may move down and out of the way so CIT personnel may remove the bag and install a new bag over the hexagonal head 108. The arms 113 of the top sealing mechanism 112 may either automatically or manually to allow access to the bag 110 and the hexagonal head 108.

Figure 20A:
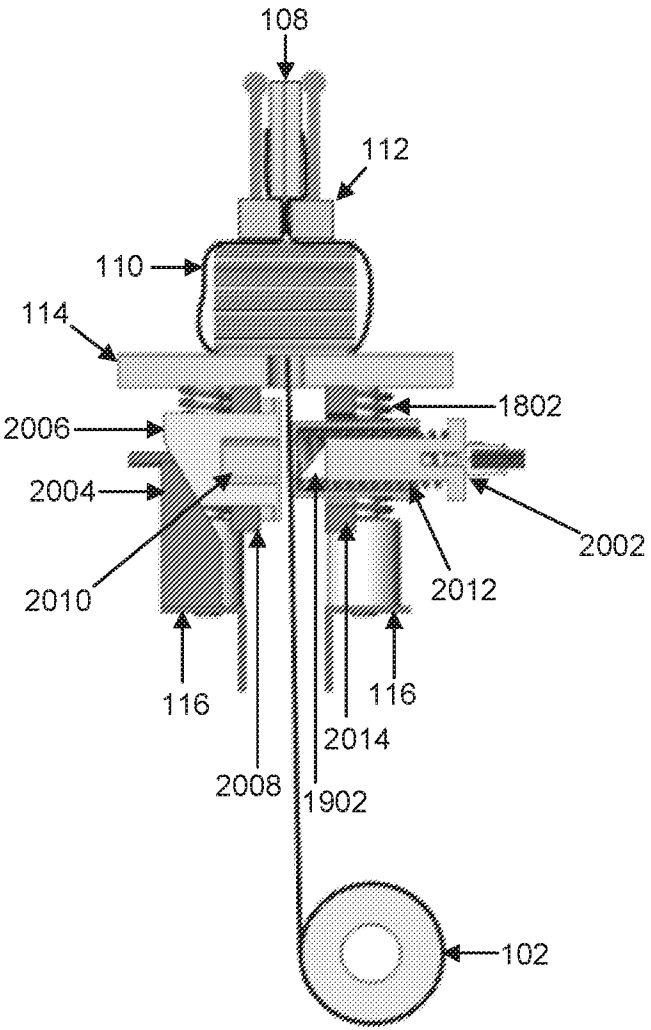
FIGS. 20A and 20B illustrate a schematic of a vacuum head with a bag piercing system according to various embodiments of the present disclosure.
Figure 20B:
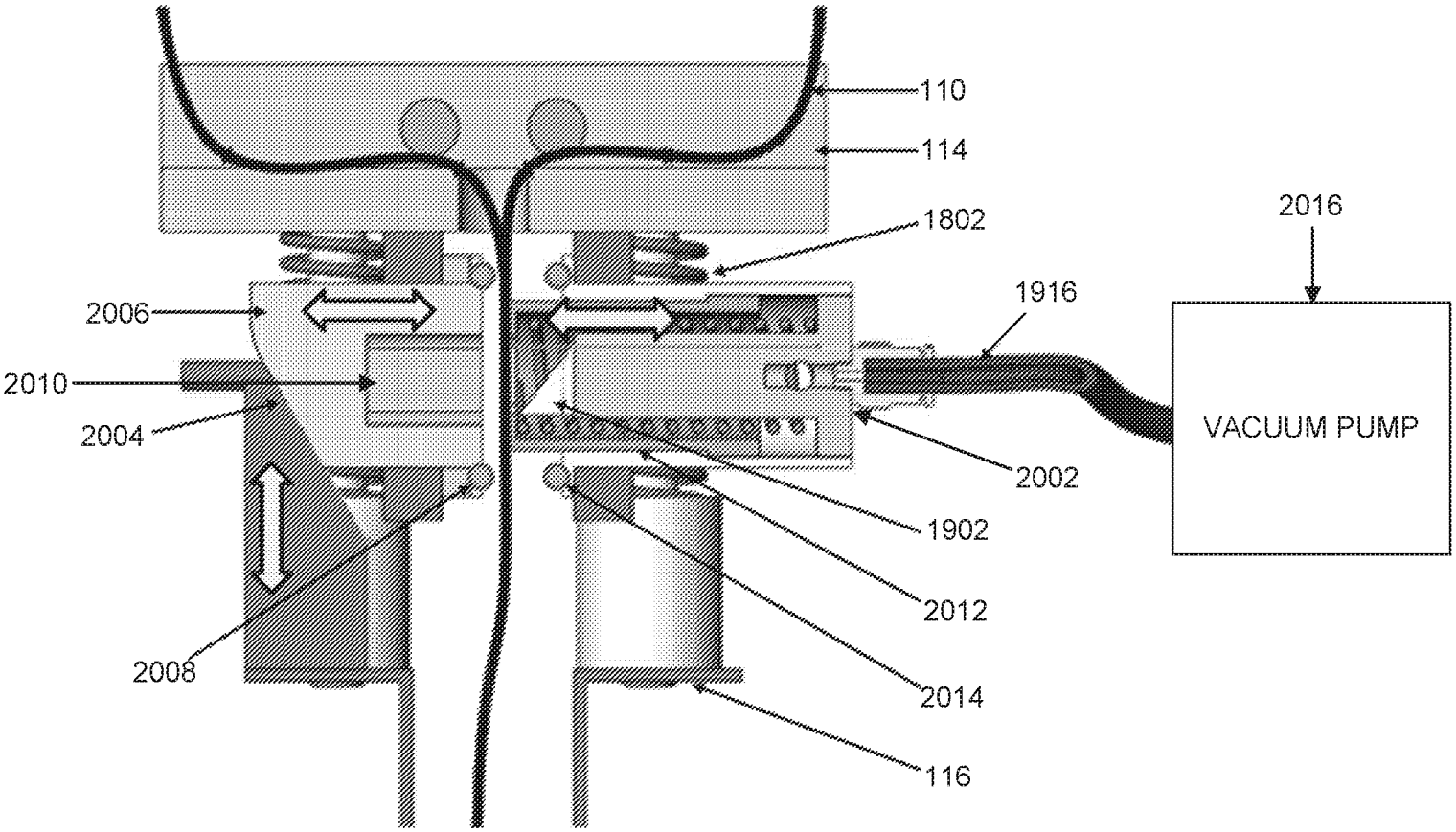

FIGS. 20A and 20B illustrate a schematic of a vacuum head 2002 with a bag piercing system according to various embodiments of the present disclosure. Vacuum heads come in a wide variety of configurations, and FIGS. 20A and 20B do not limit this disclosure to any particular implementation of a vacuum head. For example, vacuum head 2002 can be part of the sealing system 100 as shown in FIG. 1.

In FIGS. 20A and 20B, the vacuum head 2002 may be the vacuum head 1806 or the piercing head 118. As shown in FIGS. 20A-B, a cam 2004 extending up from one of the lifters 116 is connected with a first triggering slider 2006 including a gasket 2008 with a passage 2010 for the blade 1902 to pierce the bag 110. The blade 1902 may be protected by a spring loaded cap 2012 or cover. The cap 2012 may provide protection to the user against the edge of the blade 1902 while installing the bag 110. This cover also protects the bag 110 against the blade 1902. The cap 2012 and the first triggering slider 2006 maintain shape of the bag 110 during piercing that improves time used for vacuuming.

The first triggering slider 2006 pushes a passage 2010 in the first triggering slider 2006 and the bag 110 against the blade 1902 during upward movement of the lifters 116. As the upward movement of the lifters 116 pushes the first triggering slider 2006 forward, the blade 1902 pierces the bag 110. The cap 2012 may also include a gasket 2014. The pair of gaskets 2008 and 2014 connect, surrounding the spring loaded cap 2012 and first triggering slider 2006, creating an airtight connection for the vacuum. The vacuum can begin after the airtight connection. Vacuum tubing 1916 connected between the vacuum head 2002 and a vacuum pump 2016. In another example, upward movement of the lifters 116 could activate the vacuum pump 2016.

Once the vacuum is achieved, the lifters 116 again move upward. The motion of the lifters 116 a second triggering slider (such as that illustrated in FIGS. 19A-191 as heat sealer head 1914) associated with the bottom sealing mechanism 120. The bottom sealing mechanism 120 seals the bottom of the bag 110 between the pressure plate 114 and the hole created for the vacuum. One of the embodiments provides a bottom sealing mechanism 120 and a vacuum head 2002 with a bag piercing system that keeps a distance between them. Smaller distance between these two mechanisms can save volume of the bag 110 used during every cycle, resulting in lower operational cost for the operator. In addition, having the vacuum close to the roll 102 reduces the volume of air to be removed, and thus reducing time spent vacuuming.

Figure 21B:
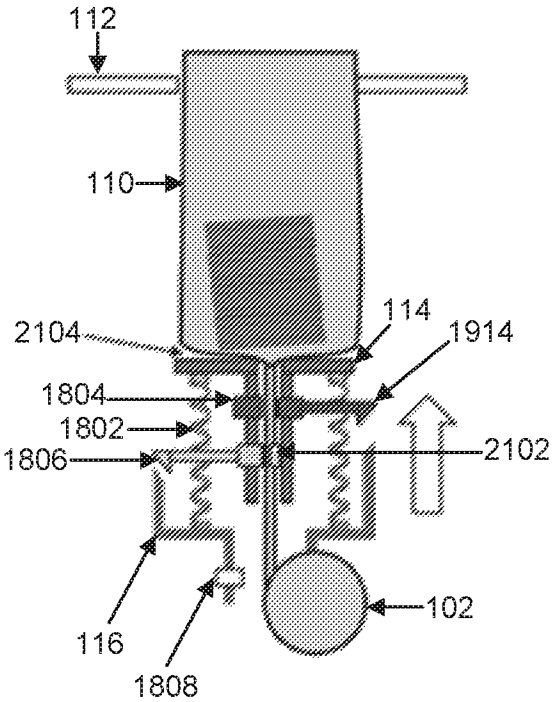
FIGS. 21A and 21B illustrate a schematic of a location of a roll of the bag according to various embodiments of the present disclosure.
Figure 21A:
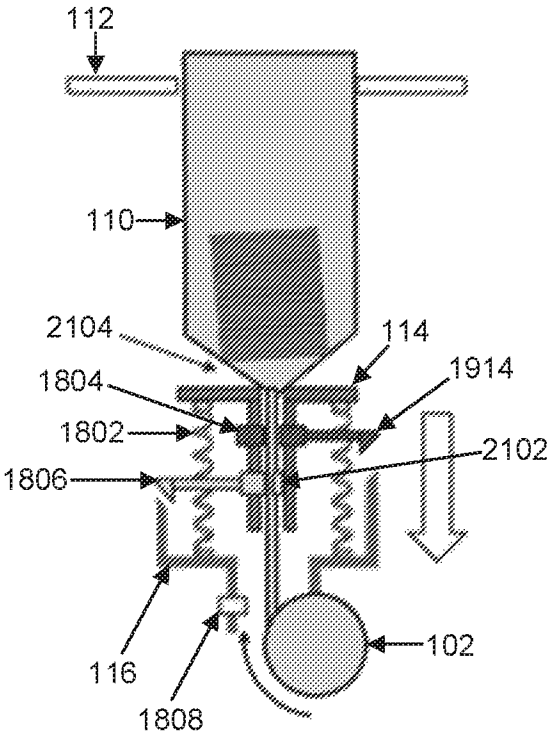

FIGS. 21A and 21B illustrate a schematic of a location of the roll 102 of the bag 110 according to various embodiments of the present disclosure. Bag rolls come in a wide variety of configurations, and FIGS. 21A and 21B do not limit this disclosure to any particular implementation of a bag roll. For example, bag roll 102 can be part of the sealing system 100 as shown in FIG. 1.

In FIGS. 21A and 21B, in some embodiments, the roll 102 is fastened to the safe 106 near the bottom of the safe 106, or to a frame. In other embodiments, the roll 102 may be fastened to the lifters 116. A bag tensioner 2102 may be connected with the pressure plate 114. The bag tensioner 2102 may be a curved surface that wraps around a portion of the bag 110 below the pressure plate 114. As the lifters 116 move down, tension on the bag 110 from the bag tensioner 2102 turns the roll 102 to pull more bag from the roll 102, as illustrated in FIG. 21B. This tension on the bag 110 can also create an angle on a bottom surface 2104 of the bag 110 above the pressure plate 114. As the lifters 116 move up, the tension on the bag 110 resolves and the bottom surface of the bag 110 may flatten against the pressure plate 114, while the banknote stack remains straight.

Figure 22B:
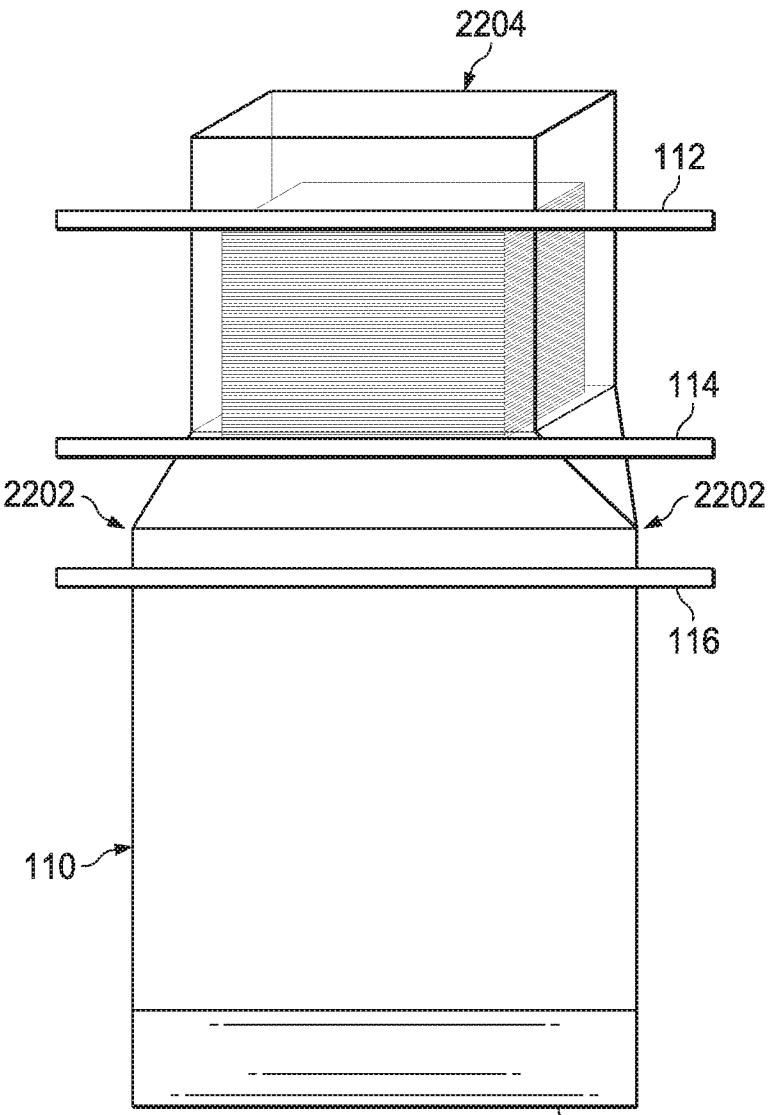
FIGS. 22A and 22B illustrate a schematic of folds generated by having a bag fastened to a safe according to various embodiments of the present disclosure.
Figure 22A:
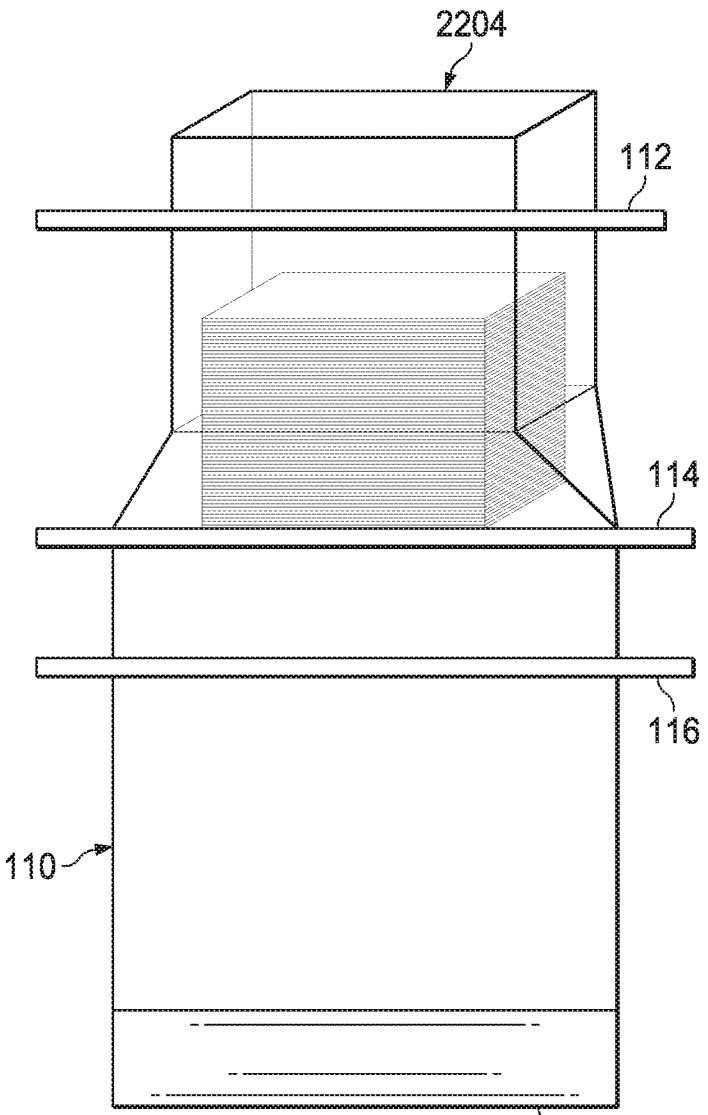

FIGS. 22A and 22B illustrate a schematic of folds 2202 generated by having a bag fastened to a safe 2204 according to various embodiments of the present disclosure. Bags and safes come in a wide variety of configurations, and FIGS. 22A and 22B do not limit this disclosure to any particular implementation of a bags or safes. For example, bag 110 and safe 2204 can be part of the sealing system 100 as shown in FIG. 1.

In FIGS. 22A and 22B, in some embodiments, the roll 102 is fastened to the lifter 116. The roll 102 of bag 110 is attached with the lifter 116 and with the bag tensioner 2102 connected with the pressure plate 114. This configuration prevents folds 2202 from appearing on the bag 110 in front of the bottom seal when the lifter 116 moves up to compress the banknote stack. The bag transition stays above the pressure plate 114 when the lifter 116 moves up. The quantity of air between the lifter and the roll is small and therefore reduces the time for vacuuming the bag.

In addition, the rapid vacuum sealing system illustrated here provides visual tamper evidence against theft. The vacuum or negative pressure in the bag can be used as a vector of information for bag integrity, as a vacuum is not easy to restore after tamper. If the vacuum is destroyed, then there is higher probability of bag being tampered.

This vacuum increases a threshold for theft as special tools such as a vacuum pump and sealing are used to restore the vacuum. For when thieves use sophisticated equipment, additional theft detection devices can be used besides vacuum. Electronic, mechanical and/or chemical sensors or detectors could be attached on the bag or inserted into the bag. These additional sensors or detectors could either indicate or store a state of the vacuum or react or indicate if the status vacuum has been modified.

One example embodiment can include a sealing system for cash bags, comprising a banknote validator, a head coupled to the banknote validator, a bag of a roll of bags, the bag configured to mount to the head, a first sealing mechanism coupled to the head and configured to seal a top portion of the bag, a second sealing mechanism configured to seal a bottom portion of the bag, and a vacuum pump configured to connect to the bag and configured to pump air from the bag.

One example embodiment can include a vacuum sealing system, comprising a head configured to mount a bag on the outside of the head and a sealing mechanism coupled to the head, wherein the sealing mechanism includes two arms, each arm attached to a top of the head, wherein each arm is rotatably coupled to the head such that the two arms are operable to rotate and close the head, wherein at least one of the two arms includes a heat sealer to thermally seal the bag when the two arms are closed around the head.

In one or more of the above examples, the sealing mechanism is configured to engage automatically after a certain amount of movement of a lifter.

In one or more of the above examples, the vacuum sealing system further comprises a pressure plate coupled to at least one spring to apply pressure against a stack of banknotes.

In one or more of the above examples, the vacuum sealing system further comprises a lifter coupled to the at least one spring, wherein movement of the lifter towards the pressure plate causes the pressure plate to press the stack of banknotes against the heat sealer to compress the bag.

In one or more of the above examples, the vacuum sealing system further comprises a first triggering slider coupled to the pressure plate, wherein the lifter interacts with the first triggering slider to activate a spring loaded cover to initiate piercing of the bag after compressing the stack of banknotes and heat sealing a top of the bag, and wherein the first triggering slider is coupled to a vacuum pump to vacuum air from the bag In one or more of the above examples, the lifter is configured to move the first triggering slider when piercing the bag to protect a hole in the bag with a pair of gaskets.

In one or more of the above examples, the vacuum sealing system further comprises a second triggering slider coupled to the pressure plate, wherein the lifter interacts with the second triggering slider to, after completion of the vacuuming, initiate a bottom heat sealing of the bag.

Another example embodiment can include a vacuum sealing system, comprising a head configured to mount a bag on the outside of the head, a pressure plate coupled to at least one spring to apply pressure against a stack of banknotes, and a bottom sealing mechanism coupled to the pressure plate, wherein the bottom sealing mechanism includes two heat sealers.

In one or more of the above examples, the bottom sealing mechanism is configured to engage automatically after a certain amount of movement of a lifter.

In one or more of the above examples, the vacuum sealing system further comprises a lifter coupled to the at least one spring, wherein movement of the lifter towards the pressure plate causes the pressure plate to compress the stack of banknotes.

In one or more of the above examples, the vacuum sealing system further comprises a first triggering slider coupled to the pressure plate, wherein the lifter interacts with the first triggering slider to activate a spring loaded cover to initiate piercing of the bag after compressing the stack of banknotes, and wherein the first triggering slider is coupled to a vacuum pump to vacuum air from the bag.

In one or more of the above examples, the lifter is configured to move the first triggering slider when piercing the bag to protect a hole in the bag with a pair of gaskets.

In one or more of the above examples, the bottom sealing mechanism includes a second triggering slider coupled to the pressure plate, wherein the lifter interacts with the second triggering slider to, after completion of the vacuuming, press the two heat sealers together, wherein a bottom of the bag is disposed between the two heat sealers.

Another example embodiment can include a method for vacuum sealing a cash bag, comprising receiving a bag mounted on the outside of a head, wherein a bottom surface of the bag is disposed on a pressure plate, receiving a stack of banknotes in the bag, moving the pressure plate down in response to receiving the stack of banknotes, thermally sealing a top of the bag with a top sealing mechanism when the stack of banknotes includes a certain amount of banknotes, vacuuming air from the bag with a vacuum pump, and thermally sealing a bottom of the bag with a bottom sealing mechanism.

In one or more of the above examples, the top sealing mechanism includes two arms attached to a top of the head, wherein each arm is rotatably coupled to the head such that the two arms are operable to rotate and close the head, and wherein at least one of the two arms includes a heat sealer.

In one or more of the above examples, the method further comprises compressing the stack of banknotes, by the pressure plate, against the heat sealer in response to movement from a lifter, wherein the lifter is coupled to at least one spring, and wherein the pressure plate is coupled to the at least one spring.

In one or more of the above examples, the method further comprises actuating a first triggering slider coupled to the pressure plate with a lifter, wherein the first triggering slider includes a spring loaded cover, and wherein the first triggering slider includes a blade coupled to the first triggering slider.

In one or more of the above examples, the method further comprises piercing the bag with the blade and activating the vacuum pump, wherein the vacuum pump is coupled to a vacuum head coupled to the first triggering slider.

In one or more of the above examples, the bottom sealing mechanism includes two heat sealers.

In one or more of the above examples, the method further comprises actuating a second triggering slider coupled to the pressure plate with the lifter and pressing the two heat sealers together in response to actuation of the second triggering slider, wherein the bottom of the bag is disposed between the two heat sealers.

Although FIGS. 1-22 illustrate one example of a rapid vacuum sealing system, various changes may be made to FIGS. 1-22. For example, the components of the rapid vacuum sealing system could be rearranged or have different patterns. Various components in FIGS. 1-22 could be omitted, combined, or further subdivided and additional components could be added according to particular needs.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A sealing system for cash bags, comprising:
- a banknote validator;
- a head coupled to the banknote validator;
- a bag roll within an interior of the sealing system, wherein a top portion of a bag is pulled from the bag roll and is configured to mount to the head;
- a first sealing mechanism coupled to the head and configured to seal the top portion of the bag;
- a second sealing mechanism configured to seal a bottom portion of the bag;
- a vacuum pump configured to connect to the bag and configured to pump air from the bag;
- a pressure plate coupled to a first end of at least one spring; and
- a lifter coupled to a second end of the at least one spring, wherein movement of the lifter towards the pressure plate causes the pressure plate to press a stack of banknotes in the bag against the first sealing mechanism to compress the bag, and wherein the movement of the lifter pulls another portion of the bag from the bag roll.

2. The sealing system of claim 1, wherein the first sealing mechanism is configured to engage automatically after a certain amount of movement of the lifter.

3. The sealing system of claim 1, further comprising:
wherein the first sealing mechanism includes a heat sealer.

4. The sealing system of claim 3, further comprising:
- a first triggering slider coupled to the pressure plate, wherein the lifter interacts with the first triggering slider to activate a spring loaded cover to initiate piercing of the bag after compressing the stack of banknotes and heat sealing a top of the bag, and wherein the first triggering slider is coupled to the vacuum pump to vacuum air from the bag.

5. The sealing system of claim 4, wherein the lifter is configured to move the first triggering slider when piercing the bag to protect a hole in the bag with a pair of gaskets.

6. The sealing system of claim 4, further comprising:
- a second triggering slider coupled to the pressure plate, wherein the lifter interacts with the second triggering slider to, after completion of the vacuuming, initiate a bottom heat sealing of the bag.

7. A vacuum sealing system, comprising:
- a head configured to mount a bag on an outside of the head;
- a bag roll within an interior of the vacuum sealing system, wherein a portion of the bag is pulled from the bag roll to be mounted on the outside of the head;
- a pressure plate coupled to a first end of at least one spring to apply pressure against a stack of banknotes;

a bottom sealing mechanism coupled to the pressure plate; and a lifter coupled to a second end of the at least one spring, wherein movement of the lifter towards the pressure plate causes the pressure plate to compress the stack of banknotes, and wherein the movement of the lifter pulls another portion the bag from the bag roll.

8. The vacuum sealing system of claim 7, wherein the bottom sealing mechanism is configured to engage automatically after a certain amount of movement of the lifter.

9. The vacuum sealing system of claim 7, further comprising:

a first triggering slider coupled to the pressure plate, wherein the lifter interacts with the first triggering slider to activate a spring loaded cover to initiate piercing of the bag after compressing the stack of banknotes, and wherein the first triggering slider is coupled to a vacuum pump to vacuum air from the bag.

10. The vacuum sealing system of claim 9, wherein the lifter is configured to move the first triggering slider when piercing the bag to protect a hole in the bag with a pair of gaskets.

11. The vacuum sealing system of claim 10, wherein the bottom sealing mechanism includes a second triggering slider coupled to the pressure plate, wherein the lifter interacts with the second triggering slider to, after completion of the vacuuming, press two heat sealers together, and wherein a bottom of the bag is disposed between two heat sealers.

12. A method for vacuum sealing a cash bag, comprising:

pulling a portion of a bag from a bag roll to mount the bag on an outside of a head, wherein a bottom surface of the bag is disposed on a pressure plate, wherein the pressure plate is coupled to a first end of at least one spring;

receiving a stack of banknotes in the bag;

moving the pressure plate down in response to receiving the stack of banknotes;

compressing the stack of banknotes, by the pressure plate, against a top sealing mechanism in response to movement from a lifter, wherein the lifter is coupled to a second end of the at least one spring, and wherein the movement of the lifter pulls another portion the bag from the bag roll;

thermally sealing a top of the bag with the top sealing mechanism when the stack of banknotes includes a certain amount of banknotes;

vacuuming air from the bag with a vacuum pump; and thermally sealing a bottom of the bag with a bottom sealing mechanism.

13. The method of claim 12, wherein the top sealing mechanism includes two arms attached to a top of the head, wherein each arm is rotatably coupled to the head such that the two arms are operable to rotate and close the head, and wherein at least one of the two arms includes a heat sealer.

14. The method of claim 12, further comprising:

actuating a first triggering slider coupled to the pressure plate with the lifter, wherein the first triggering slider includes a spring loaded cover, and wherein the first triggering slider includes a blade coupled to the first triggering slider.

15. The method of claim 14, further comprising:

piercing the bag with the blade; and activating the vacuum pump, wherein the vacuum pump is coupled to a vacuum head coupled to the first triggering slider.

16. The method of claim 15, wherein the bottom sealing mechanism includes two heat sealers.

17. The method of claim 16, further comprising:

actuating a second triggering slider coupled to the pressure plate with the lifter; and pressing the two heat sealers together in response to actuation of the second triggering slider, wherein the bottom of the bag is disposed between the two heat sealers.

* * * * *